US012259187B2

(12) United States Patent
Hanafusa et al.

(10) Patent No.: US 12,259,187 B2
(45) Date of Patent: Mar. 25, 2025

(54) HEAT EXCHANGE SYSTEM, AND FIN STRUCTURE OF HEAT EXCHANGER

(71) Applicant: Sumitomo Precision Products Co., Ltd., Amagasaki (JP)

(72) Inventors: Shota Hanafusa, Amagasaki (JP); Kenji Ando, Amagasaki (JP)

(73) Assignee: Sumitomo Precision Products Co., LTD., Amagasaki (JP)

( * ) Notice: Subject to any disclaimer, the term of this patent is extended or adjusted under 35 U.S.C. 154(b) by 252 days.

(21) Appl. No.: 17/912,120

(22) PCT Filed: Mar. 30, 2021

(86) PCT No.: PCT/JP2021/013615
§ 371 (c)(1),
(2) Date: Sep. 16, 2022

(87) PCT Pub. No.: WO2021/200992
PCT Pub. Date: Oct. 7, 2021

(65) Prior Publication Data

US 2023/0160637 A1 May 25, 2023

(30) Foreign Application Priority Data

Mar. 31, 2020 (JP) ..... 2020-062488

(51) Int. Cl.
*F28D 1/02* (2006.01)

(52) U.S. Cl.
CPC ..... *F28D 1/024* (2013.01); *F28F 2250/08* (2013.01)

(58) Field of Classification Search
CPC ..... F28D 9/0062; F28D 1/024; F28F 27/00; F28F 3/025; F28F 2215/10; F28F 2250/08
See application file for complete search history.

(56) References Cited

U.S. PATENT DOCUMENTS

2006/0289152 A1 12/2006 Leuschner et al.
2016/0305720 A1 10/2016 Rhee et al.
(Continued)

FOREIGN PATENT DOCUMENTS

CN 209609064 U 11/2019
EP 1 462 748 A1 9/2004
(Continued)

OTHER PUBLICATIONS

International Search Report (PCT/ISA/210) issued in PCT Application No. PCT/JP2021/013615 dated May 11, 2021 with English translation (five (5) pages).
(Continued)

*Primary Examiner* — Len Tran
*Assistant Examiner* — Kamran Tavakoldavani
(74) *Attorney, Agent, or Firm* — Crowell & Moring LLP

(57) ABSTRACT

A heat exchanger (1) includes a heat exchanger (1) including a separate plate (10) and a first flow path (11) which is divided by a plurality of fin portions (13*a*) and through which air flows, a fan (2), and a control unit (3) that performs control for switching between a first mode where heat exchange is performed by forcing air to flow in and a second mode where heat exchange is performed by natural convection, the plurality of fin portions (13*a*) are disposed in parallel at predetermined intervals (p1), and are formed to have an undulating shape from one end (11*b*) toward the other end (11*c*) of the first flow path (11) in a width direction of the first flow path (11), and the first flow path (11) is configured to be used in both the first mode and the second mode.

5 Claims, 12 Drawing Sheets

FIRST EMBODIMENT

(56) References Cited

U.S. PATENT DOCUMENTS

| | | | | |
|---|---|---|---|---|
| 2017/0207145 | A1 | 7/2017 | Yamada et al. | |
| 2019/0277569 | A1* | 9/2019 | Sato | F28D 1/05366 |
| 2019/0368819 | A1* | 12/2019 | Gupte | F25B 39/00 |
| 2020/0182560 | A1* | 6/2020 | Bhosale | F25B 39/04 |

FOREIGN PATENT DOCUMENTS

| | | | |
|---|---|---|---|
| EP | 2 787 316 | A1 | 10/2014 |
| GB | 1 304 207 | A | 1/1973 |
| JP | 52-2444 | U | 1/1977 |
| JP | 61-197416 | U | 12/1986 |
| JP | 5-38985 | U | 5/1993 |
| JP | 10-200278 | A | 7/1998 |
| JP | 2002-141451 | A | 5/2002 |
| WO | WO 2016/158020 | A1 | 10/2016 |

OTHER PUBLICATIONS

Japanese-language Written Opinion (PCT/ISA/237) issued in PCT Application No. PCT/JP2021/013615 dated May 11, 2021 (four (4) pages).

* cited by examiner

FIRST EMBODIMENT

FIRST EMBODIMENT

FIRST EMBODIMENT

FIRST EMBODIMENT

G2

FIRST EMBODIMENT

SWITCHING PROCESSING OF FIRST MODE AND SECOND MODE

HEAT EXCHANGE SYSTEM, AND FIN STRUCTURE OF HEAT EXCHANGER

TECHNICAL FIELD

The present invention relates to a heat exchange system and a fin structure of a heat exchanger, and in particular, to a heat exchange system and a fin structure of a heat exchanger that perform heat exchange by natural convection and heat exchange by forcing air to flow in.

BACKGROUND ART

In the related art, a heat exchange system and a fin structure of a heat exchanger that perform heat exchange by natural convection and heat exchange by forcing air to flow in are known. Such a heat exchange system is disclosed in, for example, JP-S61-197416U.

JP-S61-197416U discloses a heat exchanger including a plurality of conduits, a connecting pipe having a U shape that connects the conduits, a plurality of fins, and a motor fan. The plurality of conduits are disposed in parallel and have end portions connected by the connecting pipe having a U shape. The plurality of fins are disposed to form a forced convection part with a narrowed pitch (disposition interval) and natural convection parts. The forced convection part is provided in a central portion of the plurality of fins, and the natural convection parts are provided on right and left sides of the forced convection part. In the configuration disclosed in JP-S61-197416U, the motor fan is provided in the forced convection part. The heat exchanger disclosed in JP-S61-197416U is configured to switch between natural convection and forced convection as needed to perform cooling (heat exchange).

CITATION LIST

Patent Literature

[PTL 1] JP-S61-197416U

SUMMARY OF INVENTION

Technical Problem

Here, since the forced convection part disclosed in JP-S61-197416U has the disposition interval of the fins narrower (smaller) than in the natural convection parts, the forced convection part increases in flow path resistance. In such a configuration, though not clearly stated in JP-S61-197416U, the forced convection part cannot be used in heat exchange by natural convection. For this reason, in the configuration disclosed in JP-S61-197416U, heat exchange by natural convection is performed only in the natural convection parts, and heat exchange by forcing air to flow in is performed only in the forced convection part.

Note that, in a case where the natural convection parts and the forced convection part are formed using a plurality of fins, the plurality of fins are divided into fins used only in heat exchange by natural convection and fins used only in heat exchange by forcing air to flow in. That is, since a part of the plurality of fins is used only in heat exchange by natural convection, and the remaining fins are used only in heat exchange by forcing air to flow in, the number of fins used in heat exchange by natural convection and the number of fins used in heat exchange by forcing air to flow in decrease compared to a configuration in which heat exchange is performed using all fins. For this reason, in a case of switching between performing heat exchange by natural convection and heat exchange by forcing air to flow in, there is a problem in that heat exchange efficiency of respective heat exchange is degraded.

The invention has been accomplished to solve the problem described above, and an object of the invention is to provide a heat exchange system and a fin structure of a heat exchanger capable of, in a case of switching between performing heat exchange by natural convection and heat exchange by forcing air to flow in, suppressing degradation of heat exchange efficiency of respective heat exchange.

Solution to Problem

To achieve the above-described object, the present inventors have conducted intensive studies and have found that a plurality of fin portions in a first flow path of a heat exchanger undulate to be usable in both heat exchange by natural convection and heat exchange by forcing air to flow into the first flow path. Based on the knowledge, a heat exchange system according to a first invention includes a heat exchanger including a base portion that comes into contact with a heat exchange target, and a first flow path which is divided by a plurality of fin portions extending upward from the base portion and through which air flows, a fan that makes air flow into the first flow path, and a control unit that performs control for switching between a first mode where heat exchange of the heat exchange target is performed by forcing air to flow into the first flow path with the fan and a second mode where the heat exchange of the heat exchange target is performed by natural convection, in which the plurality of fin portions are disposed in parallel at predetermined intervals in a width direction of the first flow path, the plurality of fin portions are formed to have an undulating shape from one end toward the other end of the first flow path in the width direction of the first flow path, and the first flow path is configured to be used in both the first mode and the second mode.

In the heat exchanger according to the invention, as described above, the plurality of fin portions are disposed in parallel at the predetermined intervals in the width direction of the first flow path through which air flows, and are formed to have the undulating shape from one end toward the other end of the first flow path in the width direction of the first flow path, and the first flow path is configured to be used in both the first mode where the heat exchange is performed by forcing air to flow in and the second mode where the heat exchange is performed by the natural convection. With this, since the first flow path is used in both the first mode and the second mode, it is possible to suppress a decrease in the number of fin portions used in each heat exchange mode, compared to a configuration in which fin portions including both fin portions used only in the first mode and fin portions used only in the second mode are provided in the first flow path. Since the plurality of fin portions have the undulating shape in the width direction of the first flow path, it is possible to promote heat transfer with turbulence of flown-in air, compared to a configuration in which the plurality of fin portions do not have an undulating shape. It is possible to increase a heat transfer area without narrowing the disposition interval of the fin portions. As a result, in a case of switching between performing heat exchange by natural convection and heat exchange by forcing air to flow in, it is possible to suppress degradation of heat exchange efficiency of respective heat exchange.

In this case, preferably, the plurality of fin portions are provided continuously from the one end to the other end of the first flow path and undulate periodically such that the other end of the first flow path is visible as viewed from the one end of the first flow path. With this configuration, a through flow path is formed in the first flow path. Accordingly, it is possible to suppress an increase in pressure loss of air flowing in the first flow path, compared to a configuration in which a through flow path is not formed in the first flow path with the plurality of fin portions. As a result, even in a case where the plurality of fin portions have the undulating shape, it is possible to secure heat exchange efficiency in the second mode where heat exchange is performed by natural convection.

In the above-described configuration in which the plurality of fin portions are provided continuously from the one end to the other end of the first flow path and undulate periodically such that the other end of the first flow path is visible as viewed from the one end of the first flow path, preferably, the plurality of fin portions undulate such that an undulating pattern of the same waveform is repeated at a fixed undulation width in the width direction of the first flow path, and the undulation width is at least a size less than a half of a disposition interval of the plurality of fin portions. With this configuration, since the plurality of fin portions undulate such that the undulating pattern of the same waveform is repeated at the fixed undulation width in the width direction of the first flow path, it is possible to simplify the structure (shape) of the plurality of fin portions, compared to a configuration in which the undulation width and/or the undulating pattern of the plurality of fin portions is different halfway. Since the undulation width of the plurality of fin portions is at least the size less than a half of the disposition interval of the plurality of fin portions, it is possible to make a configuration in which the other end of the first flow path is visible as viewed from the one end of the first flow path, and to secure heat exchange efficiency in the second mode. As a result, it is possible to achieve both the simplification of the structure (shape) of the plurality of fin portions and securing of heat exchange efficiency in the second mode.

In the above-described configuration in which the plurality of fin portions are provided continuously from the one end to the other end of the first flow path and undulate periodically such that the other end of the first flow path is visible as viewed from the one end of the first flow path, preferably, the plurality of fin portions undulate such that an undulating pattern of the same waveform is repeated at a fixed undulation width in the width direction of the first flow path, the undulating pattern includes a crest portion that protrudes to one side, a trough portion that protrudes to the other side, and a connecting portion that connects the crest portion and the trough portion, in the width direction of the first flow path, and a maximum inclination angle of the connecting portion with respect to a direction from one end side to the other end side of the first flow path is within an angle range of equal to or greater than 10 degrees and equal to or less than 30 degrees.

Here, in a case where a period of undulation of the first flow path is fixed, as the maximum inclination angle of the connecting portion is greater, the effect of turbulence in the first flow path is increased, and it is possible to further increase a heat transfer area. As the heat transfer area of the first flow path is increased, it is possible to improve heat exchange performance by the first mode where air is forced to flow in. Note that, in a case where the maximum inclination angle of the connecting portion is large, since a pressure loss in the first flow path increases, heat exchange efficiency in the second mode where heat exchange is performed by natural convection of air is degraded. In a case where the period of undulation of the first flow path is fixed, as the maximum inclination angle of the connecting portion is smaller, since the effect of turbulence of the first flow path is decreased, and the heat transfer area is decreased, heat exchange performance by the first mode is degraded. Note that, in a case where the maximum inclination angle of the connecting portion is small, since the pressure loss of the first flow path decreases, heat exchange efficiency in the second mode is improved. Accordingly, the present inventors have conducted studies and have confirmed that, in a case where the maximum inclination angle of the connecting portion falls within an angle range of equal to or greater than 10 degrees and equal to or less than 30 degrees, it is possible to secure high performance in any of the heat exchange in the first mode and the heat exchange in the second mode.

In the heat exchange system according to the first invention described above, preferably, a disposition interval of the plurality of fin portions is within a range of equal to or greater than 5 mm and equal to or less than 10 mm. With this configuration, it is possible to dispose the plurality of fin portions at intervals suitable for the second mode where heat exchange is performed by natural convection. In a case where the disposition interval of the plurality of fin portions is set within this range, while high performance is obtained in the second mode where heat exchange is performed by natural convection of air, the disposition interval is large for the first mode where heat exchange is performed by forcing air to flow in. That is, in a case where the plurality of fin portions are disposed at the disposition intervals within the range of equal to or greater than 5 mm and equal to or less than 10 mm, heat exchange performance by the first mode is degraded. Accordingly, the present inventors have conducted studies and have confirmed that the plurality of fin portions have the undulating shape, such that it is also possible to secure high performance in heat exchange by the first mode even in a case where the plurality of fin portions are disposed at the disposition intervals within the range of equal to or greater than 5 mm and equal to or less than 10 mm.

In the heat exchanger according to the invention described above, preferably, the plurality of fin portions are disposed at equal intervals over a whole width in the width direction of the first flow path. With this configuration, since the plurality of fin portions are disposed at the equal intervals over the whole width in the width direction of the first flow path, it is possible to perform heat exchange by the first mode and heat exchange by the second mode using the whole first flow path, unlike a configuration in which a part where heat exchange is performed by the first mode and a part where heat exchange is performed by the second mode are formed by changing the disposition interval of the plurality of fin portions. As a result, it is possible to suppress degradation of heat exchange efficiency of each heat exchange mode.

In the heat exchange system according to the first invention described above, preferably, the control unit is configured to switch between the first mode and the second mode based on a temperature of the heat exchange target. With this configuration, since the first mode and the second mode are switched based on the temperature of the heat exchange target, it is possible to suppress an increase in power consumption, for example, compared to a configuration in which heat exchange is constantly by the first mode. It is possible to efficiently perform the heat exchange of the heat exchange target, for example, compared to a configuration in which heat exchange is constantly performed by the second mode. As a result, it is possible to efficiently perform the heat exchange of the heat exchange target while suppressing an increase in power consumption.

In the heat exchange system according to the first invention described above, preferably, the heat exchange target includes a heat exchange target fluid, and the heat exchanger further includes a second flow path through which the heat exchange target fluid flows in a state of being in contact with the base portion where a plurality of fin portions are provided. With this configuration, it is possible to easily bring the base portion in which the plurality of fin portions are provided, and the heat exchange target fluid into contact with each other by making the heat exchange target fluid flow into the second flow path, and to easily perform the heat exchange of the heat exchange target fluid.

A fin structure of a heat exchanger according to a second invention includes a base portion that comes into contact with a heat exchange target, and a plurality of fin portions provided to extend upward from the base portion, in which the plurality of fin portions form a first flow path through which air flows, have an undulating shape from one end toward the other end of the formed first flow path in a width direction of the first flow path, are disposed at equal intervals over a whole width in the width direction of the first flow path, are provided continuously from the one end to the other end of the first flow path, and, undulate periodically such that the other end of the first flow path is visible as viewed from the one end of the first flow path, and in performing heat exchange of the heat exchange target, the first flow path is configured to be used in both forced heat exchange where the heat exchange of the heat exchange target is performed by forcing air to flow into the first flow path and natural heat exchange where the heat exchange of the heat exchange target is performed by natural convection.

In the fin structure of a heat exchanger according to the second invention, as described above, the plurality of fin portions are disposed in parallel at the predetermined intervals in the width direction of the first flow path, and have the undulating shape from one end toward the other end of the first flow path in the width direction of the first flow path. With this, like the heat exchange system according to the first invention described above, in a case of switching between performing heat exchange by natural convection and heat exchange by forcing air to flow in, it is possible to provide the fin structure of the heat exchanger capable of suppressing degradation of heat exchange efficiency of respective heat exchange. In the fin structure of the heat exchanger according to the second invention, the plurality of fin portions are disposed at the equal intervals over the whole width in the width direction of the first flow path. With this, since the plurality of fin portions are disposed at the equal intervals over the whole width in the width direction of the first flow path, it is possible to perform heat exchange by the first mode and heat exchange by the second mode using the whole first flow path, unlike a configuration in which a part where heat exchange is performed by the first mode and a part where heat exchange is performed by the second mode are formed by changing the disposition interval of the plurality of fin portions halfway of the first flow path. As a result, it is possible to suppress degradation of heat exchange efficiency of each heat exchange mode.

In the fin structure of the heat exchanger according to the second invention, the plurality of fin portions are provided continuously from one end to the other end of the first flow path, and undulate periodically such that the other end of the first flow path is visible as viewed from one end of the first flow path. With this, a through flow path is formed in the first flow path. Accordingly, it is possible to suppress an increase in pressure loss of air flowing in the first flow path, compared to a configuration in which a through flow path is not formed in the first flow path with the plurality of fin portions. As a result, even in a case where the plurality of fin portions have the undulating shape, it is possible to secure heat exchange efficiency in the second mode where heat exchange is performed by natural convection.

Advantageous Effects of Invention

According to the invention, as described above, in a case of switching between performing heat exchange by natural convection and heat exchange by forcing air to flow in, it is possible to suppress degradation of heat exchange efficiency of respective heat exchange.

DESCRIPTION OF EMBODIMENTS

Hereinafter, embodiments of the invention will be described based on the drawings.

First Embodiment (Configuration of Heat Exchanger)

First, an overall configuration of a heat exchange system 100 according to the present embodiment will be described with reference to FIGS. 1 to 4.

(Overall Configuration)

Figure 1:
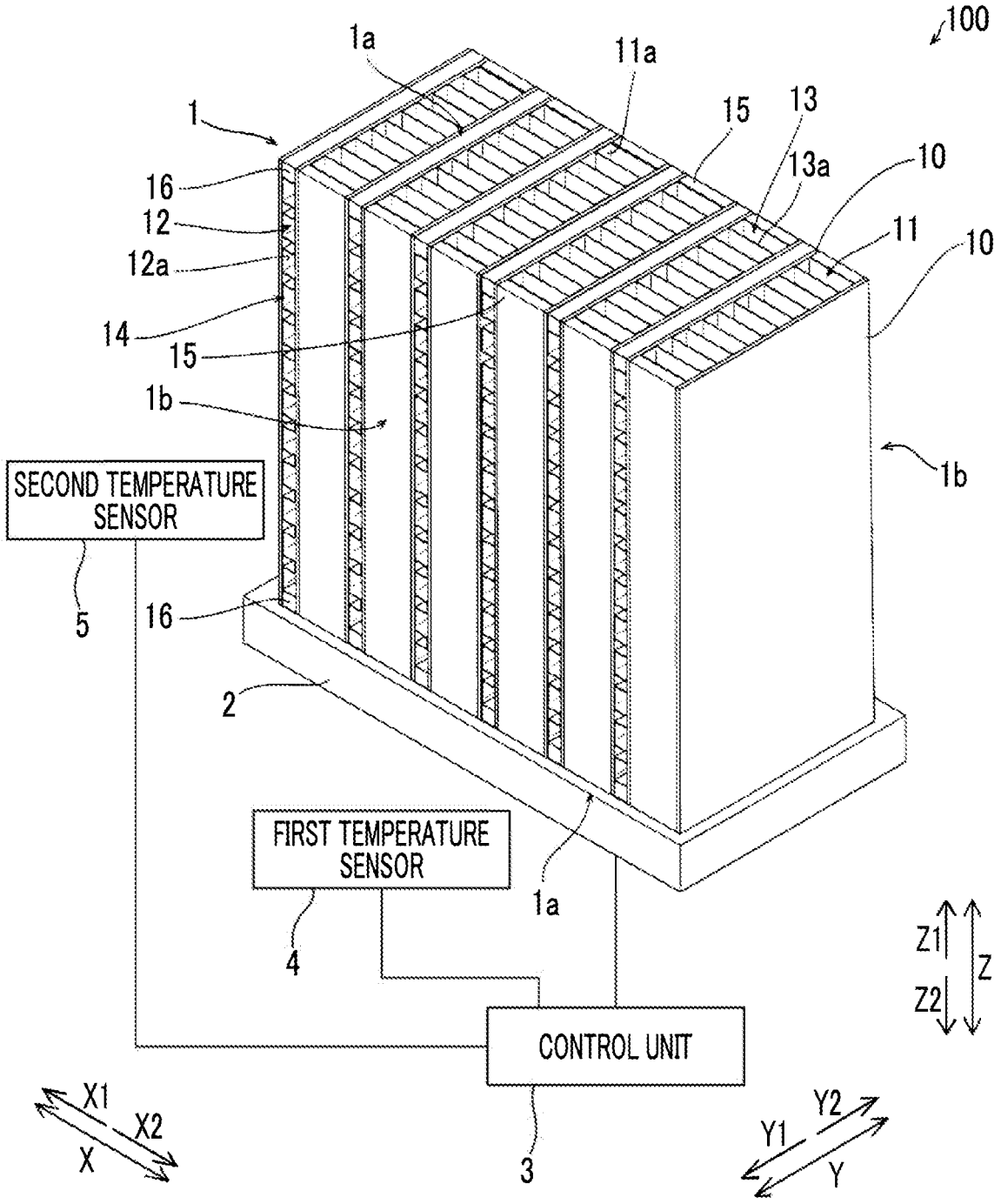
FIG. 1 is a perspective view showing a heat exchange system according to a first embodiment.

As shown in FIG. 1, a heat exchange system 100 includes a heat exchanger 1, a fan 2, a control unit 3, a first temperature sensor 4, and a second temperature sensor 5. In the present specification, an up-down direction is represented as a Z direction, an up direction is represented as a Z1 direction, and a down direction is represented as a Z2 direction. Two directions perpendicular to each other within a plane perpendicular to the Z direction are represented as an X direction and a Y direction. In the X direction, one side is represented as an X1 direction, and the other side is represented as an X2 direction. In the Y direction, one side is represented as a Y1 direction, and the other side is represented as a Y2 direction.

The heat exchanger 1 has an opening that is an inlet or an outlet of a fluid and is configured to make the fluid flow to perform heat exchange. FIG. 1 shows an example where the heat exchanger 1 is a plate fin type heat exchanger. The plate fin type heat exchanger 1 has a rectangular parallelepiped shape including a surface (side surface) where the opening is formed. The heat exchanger 1 has a flow path for making the fluid flow inside and is configured to perform heat exchange in a process of making the fluid flow. The heat exchange that is performed by the heat exchanger 1 includes cooling and heating. In the present embodiment, a case where the heat exchanger 1 performs cooling of a heat exchange target will be described.

The heat exchanger 1 has a structure in which separate plates 10, first corrugated fins 13, and second corrugated fins 14 are laminated. First side bars 15 are disposed on in outer peripheral portions of each first corrugated fin 13. Second side bars 16 are disposed in outer peripheral portions of each second corrugated fin 14. The first corrugated fins 13, the second corrugated fins 14, the separate plates 10, the first side bars 15, and the second side bars 16 are bonded by brazing, whereby the heat exchanger 1 is configured. Each separate plate 10 is an example of a "base portion" in the claims.

A first flow path 11 is divided by the separate plate 10, the first side bar 15, and the separate plate 10, and is configured with each layer where the first corrugated fin 13 is disposed inside. Air as the fluid flows in the first flow path 11. In the present embodiment, the first flow path 11 is formed to extend in the up-down direction (Z direction). In the example shown in FIG. 1, the Y direction is a width direction of the first flow path 11. The X direction is a height direction of the first flow path 11.

A second flow path 12 is divided by the separate plate 10, the second side bar 16, and the separate plate 10, and is configured with each layer where the second corrugated fin 14 is disposed inside. A heat exchange target fluid flows in the second flow path 12 in a state of being in contact with the separate plate 10.

In the present embodiment, the heat exchanger 1 performs heat exchange between air and the heat exchange target fluid flowing in the first flow path 11 and the second flow path 12, respectively. In the example shown in FIG. 1, air flows into the first flow path 11 from a Z2 direction side and flows out from a Z1 direction side. The heat exchange target fluid flows into the second flow path 12 from a Y1 direction side and flows out from a Y2 direction side.

The separate plate 10 has a rectangular shape. The separate plate 10 is configured to come into contact with the heat exchange target. The heat exchange target includes the heat exchange target fluid. The heat exchange target fluid includes, for example, oil or a refrigerant.

The heat exchanger 1 has a structure in which the first flow path 11 and the second flow path 12 are alternately laminated such that the first flow path 11 and the second flow path 12 are perpendicular to each other. The first flow path 11 and the second flow path 12 are laminated in the X direction.

In the example of FIG. 1, the heat exchanger 1 includes surfaces 1*a* where an opening 11*a* of the first flow path 11 is formed and surfaces 1*b* where an opening 12*a* of the second flow path 12 is formed. The opening 11*a* of the first flow path 11 is formed in both surfaces 1*a* in the Z direction and the opening 12*a* of the second flow path 12 is formed in both surfaces 1*b* on a Y direction side perpendicular to the surface 1*a*. The opening 11*a* is formed in a portion of the surface 1*a* excluding the second flow path 12. The opening 12*a* is formed in a portion of the surface 1*b* excluding the first flow path 11.

The fan 2 is configured to make air flow into the first flow path 11 under the control of the control unit 3. The fan 2 is configured to make air flow into the first flow path 11 from the opening 11*a* on the Z2 direction side. The fan 2 is provided in a state of being in contact with the surface 1*a* on the Z2 direction side to close the opening 11*a* on the Z2 direction side. The fan 2 includes, for example, a blower that blows air into the first flow path 11.

The control unit 3 is configured to perform control for switching between a first mode where the heat exchange of the heat exchange target is performed by forcing air to flow into the first flow path 11 with the fan 2 and a second mode where the heat exchange of the heat exchange target is performed by natural convection. The control unit 3 is configured to acquire a temperature difference between air and the heat exchange target based on a temperature of air acquired by the first temperature sensor 4 and a temperature of the heat exchange target acquired by the second temperature sensor 5. In the present embodiment, the first flow path 11 is configured to be used in both the first mode and the second mode. The control unit 3 includes, for example, a central processing unit (CPU), a read only memory (ROM), and a random access memory (RAM).

The first temperature sensor 4 is configured to acquire the temperature of air. The first temperature sensor 4 is provided in the vicinity of the opening 11*a* on the Z2 direction side and acquires the temperature of air flowing into the first flow path 11. The first temperature sensor 4 is configured to output the acquired temperature of air to the control unit 3.

The second temperature sensor 5 is configured to acquire the temperature of the heat exchange target. The second temperature sensor 5 is provided in the vicinity of the opening 12*a* on the Y1 direction side and acquires the temperature of the heat exchange target flowing into the second flow path 12. The second temperature sensor 5 is configured to output the acquired temperature of the heat exchange target to the control unit 3.

(Configuration of First Flow Path)

Figure 2:
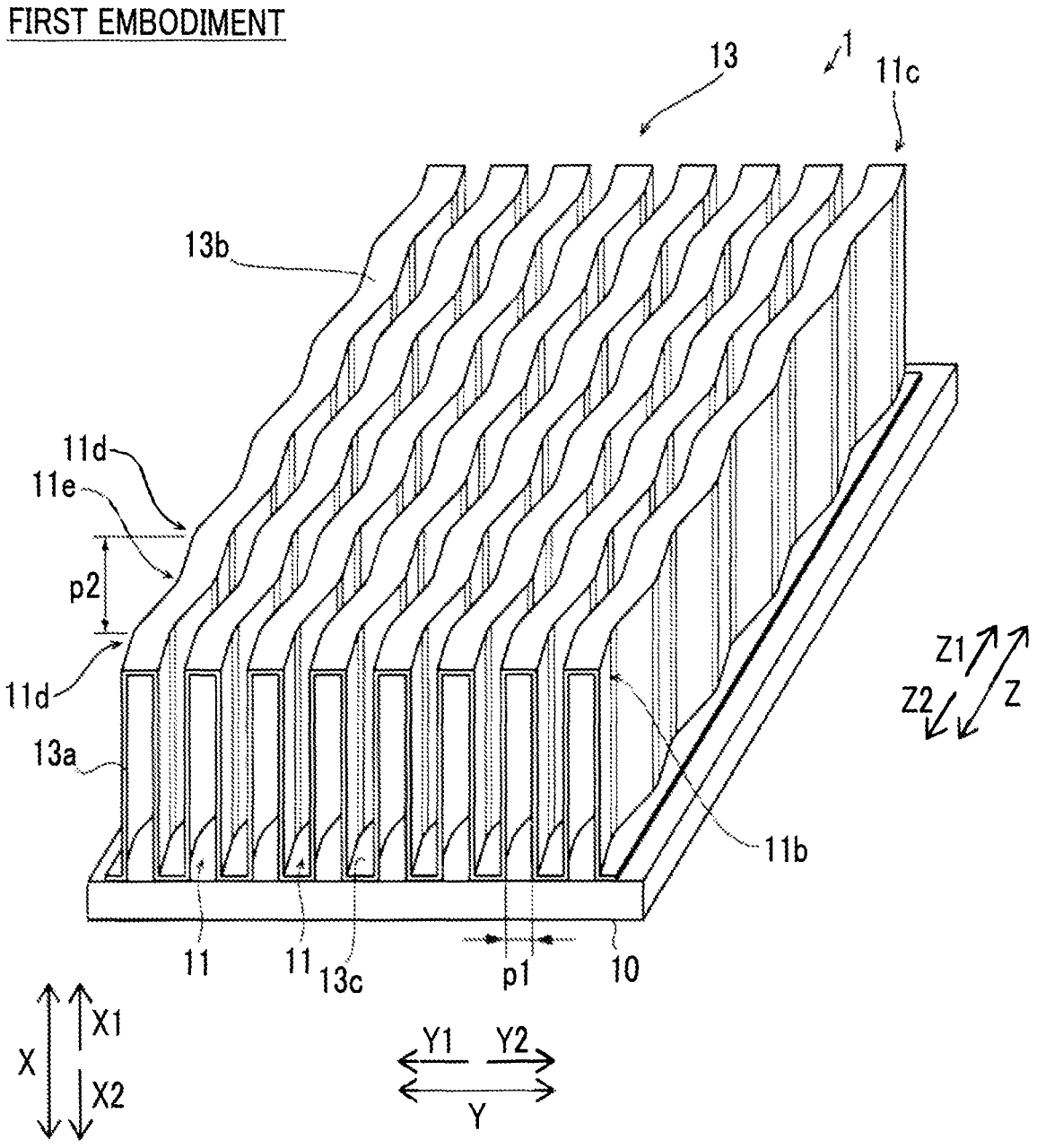
FIG. 2 is a perspective view showing a base portion and a plurality of fin portions of a heat exchanger according to the first embodiment.

Next, the configuration of the first flow path 11 will be described with reference to FIG. 2. As shown in FIG. 2, the first flow path 11 is formed by the separate plate 10 and one first corrugated fin 13. In an example of FIG. 2, for convenience, the separate plate 10 on an X1 direction side is not shown.

As shown in FIG. 2, the separate plate 10 extends along a YZ plane. In the example shown in FIG. 2, the separate plate 10 has long sides disposed in an orientation along the Z direction. The first corrugated fin 13 includes a plurality of fin portions 13*a*, a first connecting portion 13*b*, and a second connecting portion 13*c*. The plurality of fin portions 13*a* are provided to extend upward from the separate plate 10. The plurality of fin portions 13*a* are provided to extend upward from the separate plate 10 from an X2 direction side toward the X1 direction side. The plurality of fin portions 13*a* are connected by the first connecting portion 13*b* on the X1 direction side. The plurality of fin portions 13*a* are connected by the second connecting portion 13*c* on the X2 direction side. The first connecting portion 13*b* and the second connecting portion 13*c* are alternately provided in the Y direction. The first flow path 11 is divided by the plurality of fin portions 13*a* provided to extend upward from the separate plate 10.

As shown in FIG. 2, the plurality of fin portions 13*a* are disposed in parallel at predetermined intervals p1 in the width direction (Y direction) of the first flow path 11. The plurality of fin portions 13*a* are formed to have an undulating shape from one end 11*b* toward the other end 11*c* of the first flow path 11 in the width direction (Y direction) of the first flow path 11. Specifically, the plurality of fin portions 13*a* are disposed at the intervals p1 and at equal intervals over the whole width in the width direction (Y direction) of the first flow path 11. The interval p1 of the plurality of fin portions 13*a* is a distance of a gap portion of the fin portions 13*a* excluding a plate thickness. The undulating shape is a shape in which a crest portion 11*d* and a trough portion 11*e* are alternately repeated in a direction (Z direction) from one end 11*b* toward the other end 11*c* of the first flow path 11.

In the present embodiment, the plurality of fin portions 13*a* undulate in a period p2. The period p2 is a distance between the crest portions 11*d* on the Y1 direction side of the fin portion 13*a* in the Z direction.

Figure 3:
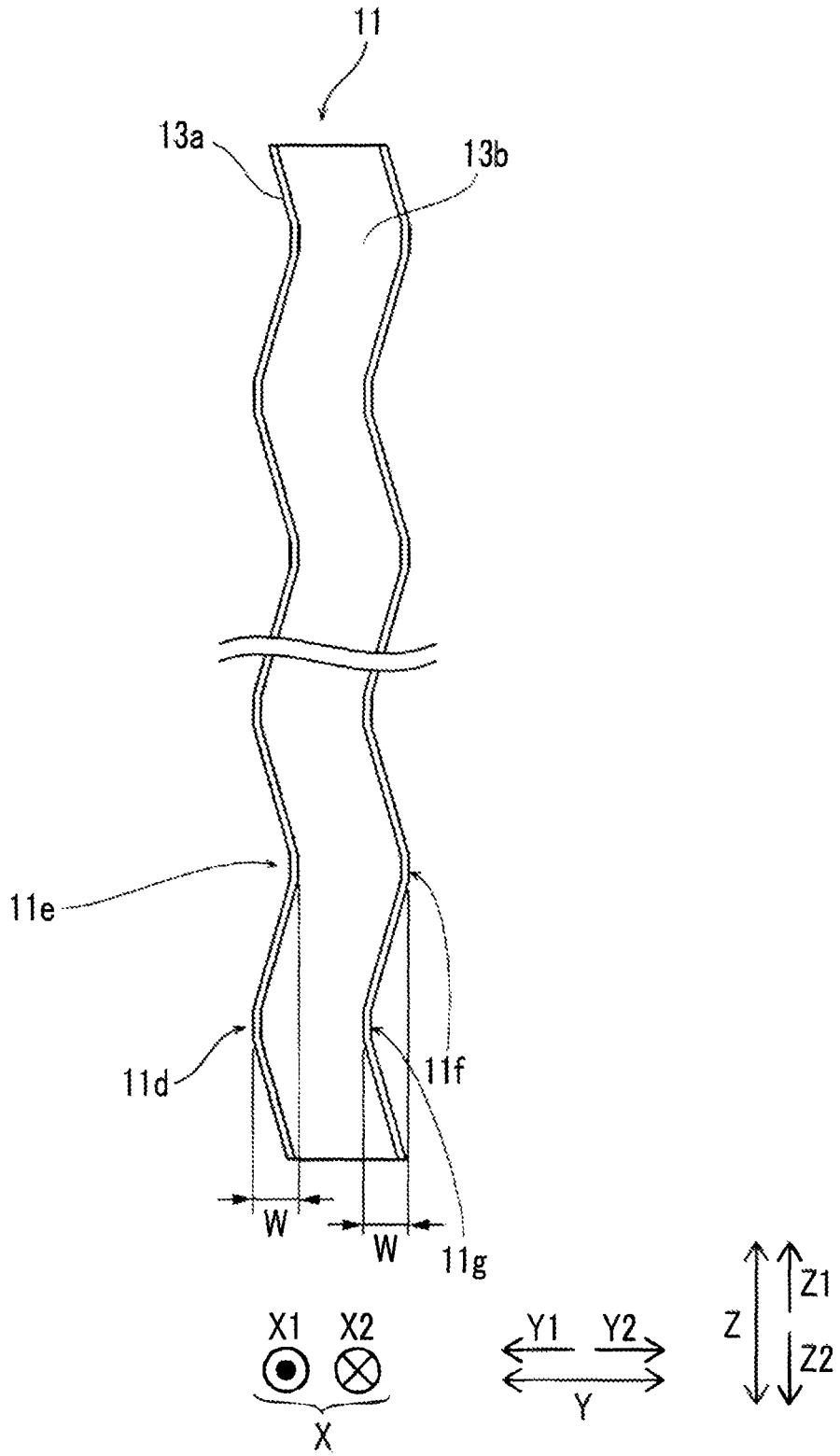
FIG. 3 is a schematic view as a first flow path according to the first embodiment is viewed from an X1 direction.

As shown in FIG. 3, the plurality of fin portions 13*a* undulate such that an undulating pattern of the same waveform is repeated at a fixed undulation width W in the width direction (Y direction) of the first flow path 11. The undulation width W is a distance between the crest portion 11*d* on the Y1 direction side of the fin portion 13*a* and the trough portion 11*e* on the Y1 direction side of the fin portion 13*a*. The undulating pattern means a unit of repetition in the Z direction in a case where the plurality of fin portions 13*a* undulate.

In the present embodiment, since the undulation width W is fixed, the distance between a trough portion 11*g* on the Y2 direction side of the fin portion 13*a* and a crest portion 11*f* on the Y2 direction side of the fin portion 13*a* is equal to the distance between the crest portion 11*d* on the Y1 direction side of the fin portion 13*a* and the trough portion 11*e* on the Y1 direction side of the fin portion 13*a*.

Figure 4:
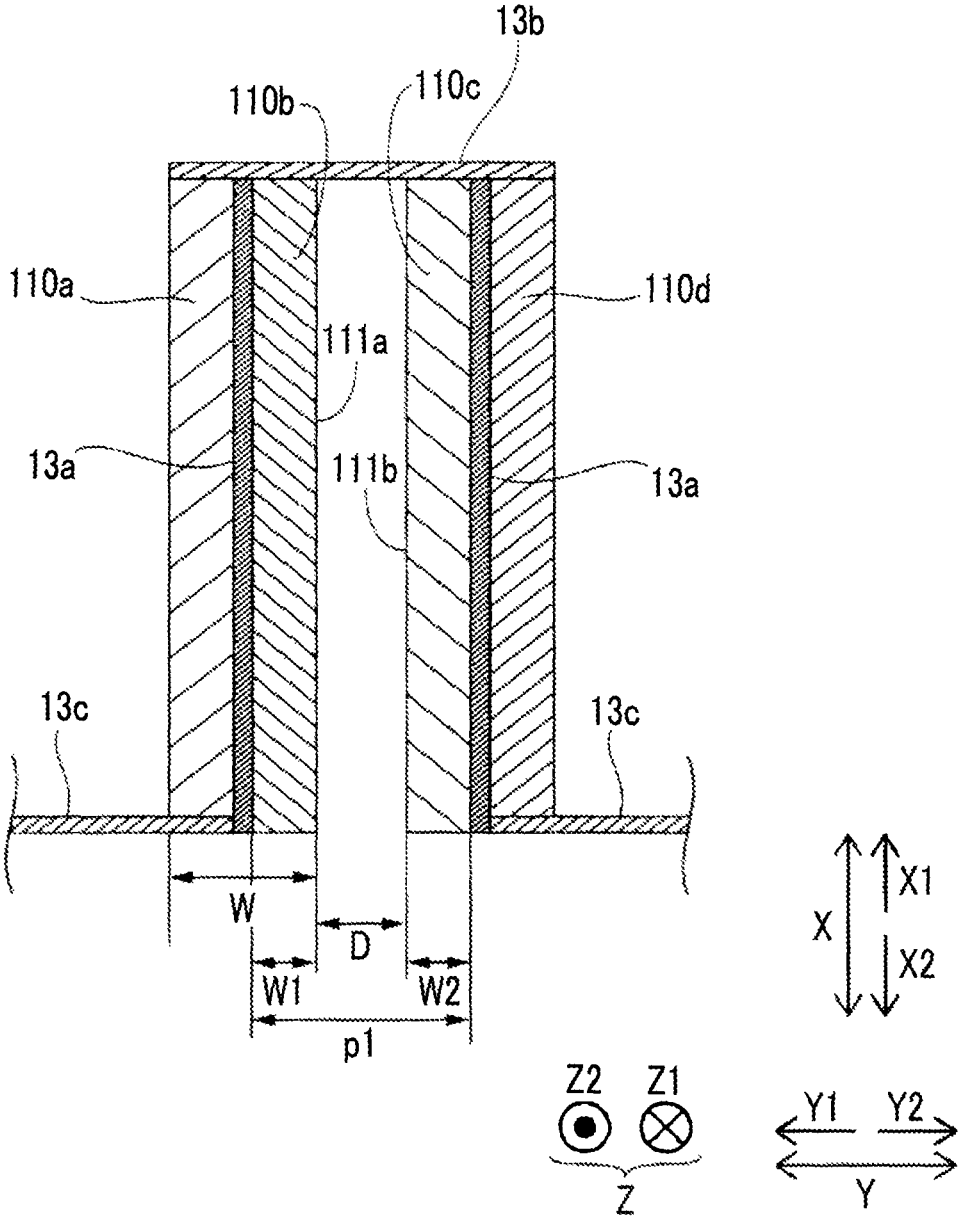
FIG. 4 is a schematic view as the first flow path according to the first embodiment is viewed from a Z1 direction.

FIG. 4 is a schematic view as the first flow path 11 is viewed from the Z1 direction side. FIG. 4 shows the fin portions 13*a*, the first connecting portion 13*b*, the second connecting portions 13*c*, a surface 110*a* in the crest portion 11*d* (see FIG. 3) of the fin portion 13*a* that is visible from the Z2 direction side, a surface 110*b* in the trough portion 11*e* (see FIG. 3) of the fin portion 13*a* that is visible from the Z2 direction side, a surface 110*c* in the crest portion 11*f* (see FIG. 3) of the fin portion 13*a* that is visible from the Z2 direction side, and a surface 110*d* in the trough portion 11*g* (see FIG. 3) of the fin portion 13*a* that is visible from the Z2 direction side. FIG. 4 is not a sectional view, and the separate plate 10, the fin portions 13*a*, the first connecting portion 13*b*, the second connecting portions 13*c*, and the surface 110*a* to the surface 110*d* are hatched differently for ease of identification.

As shown in FIG. 4, the plurality of fin portions 13*a* undulate periodically such that the other end 11*c* of the first flow path 11 is visible as viewed from one end 11*b* of the first flow path 11. Specifically, the undulation width W is at least a size less than a half of the interval p1 of the plurality of fin portions 13*a*. In other words, the plurality of fin portions 13*a* undulate such that a distance D between an end portion 111*a* on the Y2 direction side of the surface 110*b* and an end portion 111*b* on the Y1 direction side of the surface 110*c* is not 0 (zero). That is, the plurality of fin portions 13*a* undulate such that a size obtained by adding a width W1 in the Y direction of the surface 110*b* and a width W2 in the Y direction of the surface 110*c* of each of the plurality of fin portions 13*a* is smaller than the interval p1 of the plurality of fin portions 13*a*. In the present embodiment, the interval p1 of the plurality of fin portions 13*a* is within a range of equal to or greater than 5 mm and equal to or less than 10 mm. In the present embodiment, the interval p1 of the plurality of fin portions 13*a* is, for example, about 8 mm. In the present embodiment, a thickness of the first fin portion is about 0.25 mm.

In the present embodiment, in performing the heat exchange of the heat exchange target, the first flow path 11 is used in both forced heat exchange where the heat exchange of the heat exchange target is performed by forcing air to flow into the first flow path 11 and natural heat exchange where the heat exchange of the heat exchange target is performed by natural convection. Hereinafter, it has been confirmed that the heat exchanger 1 according to the present embodiment can be used in both forced heat exchange and natural heat exchange by performing a simulation using the heat exchanger 1 according to the present embodiment and the comparative example. A simulation result described below is obtained by cooling the heat exchange target using the heat exchanger 1 according to the embodiment and a comparative example.

(Simulation Result of Heat Exchange Amount)

Figure 5:
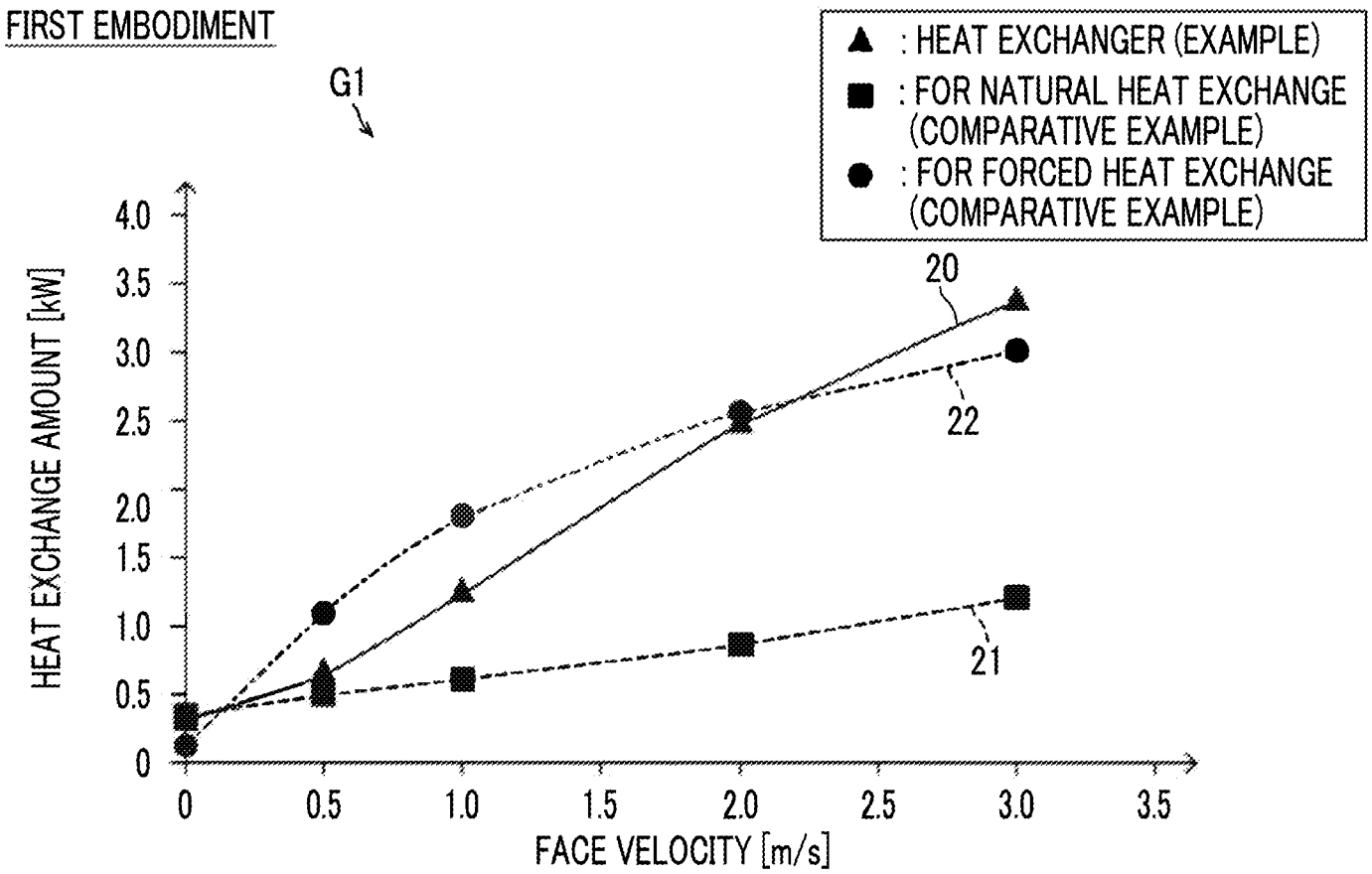
FIG. 5 is a simulation result showing change in heat exchange amount in changing a front face wind velocity using the heat exchanger according to the first embodiment and a heat exchanger according to a comparative example.

A graph G1 shown in FIG. 5 shows change in heat exchange amount in changing a front face wind velocity using the heat exchanger 1 in the present embodiment and a heat exchanger according to the comparative example. The graph G1 takes a heat exchange amount (kW: kilowatt) as the vertical axis and takes a front face wind velocity (m/s: millimeters per second) as the horizontal axis. The front face wind velocity is a wind velocity of air in the opening 11*a* in flowing into the heat exchanger 1, and is not a wind velocity of air that flows among the plurality of fin portions 13*a*. The simulation result shown in the graph G1 is a result obtained by performing a simulation in a state where a temperature of air in the opening 11*a* in flowing into the first flow path 11 is fixed at 30 degrees, and a temperature of the heat exchange target fluid that flows in the second flow path 12 is fixed at 85 degrees.

In the graph G1, as an example, a heat exchanger in which fins having a thickness of about 0.25 mm are disposed at disposition intervals of about 8 mm is used. As a comparative example, a heat exchanger for natural heat exchange that includes fins disposed suitably for natural heat exchange and a heat exchanger for forced heat exchange that includes fins suitable for forced heat exchange are used. The heat exchanger for natural heat exchange is, for example, a heat exchanger in which fins having a thickness of about 0.25 mm are disposed at disposition intervals of about 8 mm. The heat exchanger for forced heat exchange is, for example, a heat exchanger in which fins having a thickness of about 0.25 mm are disposed at disposition intervals of about 3.4 mm. Both the fins of the heat exchanger for natural heat exchange and the fins of the heat exchanger for forced heat exchange do not have an undulating shape from one end toward the other end of the first flow path in the Y direction. The fins of the heat exchanger for natural heat exchange and the fins of the heat exchanger for forced heat exchange are configured with plain type corrugated fins.

In the graph G1, a simulation result of the heat exchanger 1 according to the present embodiment is shown by a solid line 20. A simulation result of the heat exchanger for natural heat exchange is shown by a broken line 21. A simulation result of the heat exchanger for forced heat exchange is shown by a one-dot chain line 22. In the graph G1, for convenience, a value of a simulation result by natural heat exchange is shown at a position where the front face wind velocity is 0 (zero).

As shown in the graph G1, in a case where the front face wind velocity is 0 (zero), a result shows that the heat exchange amount of the heat exchanger for natural heat exchange is the greatest, and the heat exchange amount of the heat exchanger 1 according to the present embodiment is the second greatest, and the heat exchange amount of the heat exchanger for forced heat exchange is the smallest. A case where the front face wind velocity is 0 (zero) is heat exchange by natural convection. That is, a case where the front face wind velocity is 0 (zero) is heat exchange by the second mode. A case where the front face wind velocity is equal to or higher than 0 (zero) is heat exchange by the first mode.

As shown in the graph G1, in a case where the front face wind velocity increases to 0.5 (m/s), the heat exchange amount of the heat exchanger for forced heat exchange is the greatest, and the heat exchange amount of the heat exchanger for natural heat exchange is the smallest. In a range of the front face wind velocity of 0.5 (m/s) to 2.0 (m/s), the heat exchange amount of the heat exchanger for forced heat exchange is the greatest, and the heat exchange amount of the heat exchanger for natural heat exchange is the smallest. In a case where the front face wind velocity increases higher than 2.0 (m/s), the heat exchange amount of the heat exchanger 1 according to the present embodiment is the greatest, and the heat exchange amount of the heat exchanger for natural heat exchange is the smallest. Specifically, in a case where the front face wind velocity is 2.0 (m/s), a ratio of the heat exchange amount of the heat exchanger 1 according to the present embodiment to the heat exchange amount of the heat exchanger for forced heat exchange is about 96%. A ratio of the heat exchange amount of the heat exchanger for natural heat exchange to the heat exchange amount of the heat exchanger for forced heat exchange is about 39%. In a case where the front face wind velocity is 3.0 (m/s), a ratio of the heat exchange amount of the heat exchanger 1 according to the present embodiment to the heat exchange amount of the heat exchanger for forced heat exchange is about 112%. A ratio of the heat exchange amount of the heat exchanger for natural heat exchange to the heat exchange amount of the heat exchanger for forced heat exchange is about 40%. That is, it has been confirmed that the heat exchanger 1 according to the present embodiment has heat exchange efficiency equal to or higher than the heat exchanger for forced heat exchange in the heat exchange by the first mode.

With the heat exchanger 1 according to the present embodiment, in the heat exchange by the second mode, a ratio of the heat exchange amount of the heat exchanger 1 according to the present embodiment to the heat exchange amount of the heat exchanger for natural heat exchange is about 93%. A ratio of the heat exchange amount of the heat exchanger for forced heat exchange to the heat exchange amount of the heat exchanger for natural heat exchange is about 39%. That is, it has been confirmed that the heat exchanger 1 according to the present embodiment has heat exchange efficiency equal to the heat exchanger for natural heat exchange in the heat exchange by the second mode. With this, it has been confirmed that the heat exchanger 1 according to the present embodiment can be used in both the first mode and the second mode.

(Simulation Result of Pressure Loss)

Figure 6:
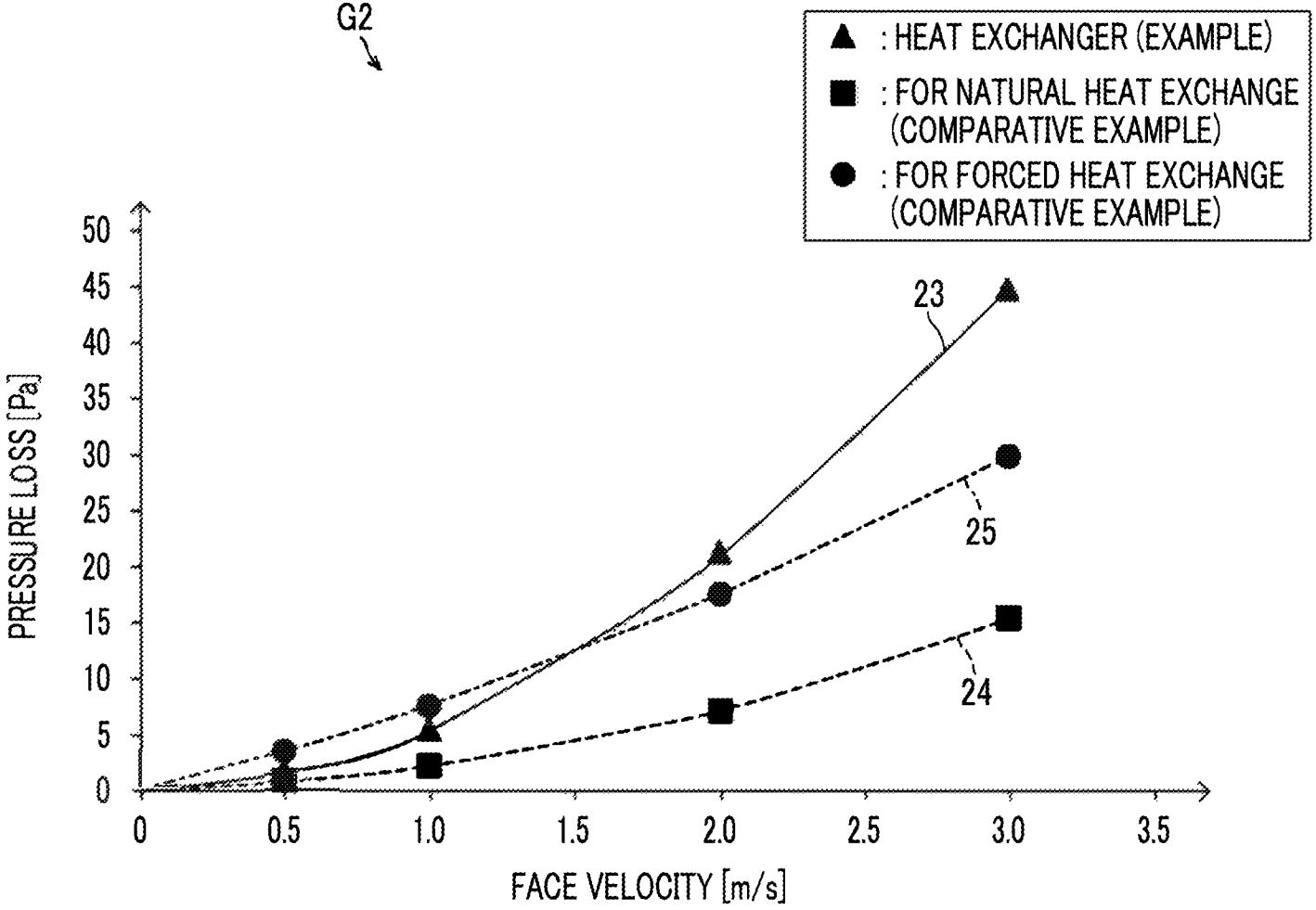
FIG. 6 is a simulation result showing change in pressure loss in changing the front face wind velocity using the heat exchanger according to the first embodiment and the heat exchanger according to the comparative example.

A graph G2 shown in FIG. 6 shows change in pressure loss in changing the front face wind velocity using the heat exchanger 1 in the present embodiment and the heat exchanger according to the comparative example. The graph G2 takes a pressure loss (Pa: pascal) as the vertical axis and takes a front face wind velocity (m/s: millimeters per second) as the horizontal axis. In the graph G2, a simulation is performed using the heat exchanger 1 according to the present embodiment, the heat exchanger for natural heat exchange, and the heat exchanger for forced heat exchange.

In the graph G2, a simulation result of the heat exchanger 1 according to the present embodiment is shown by a solid line 23. A simulation result of the heat exchanger for natural heat exchange is shown by a broken line 24. A simulation result of the heat exchanger for forced heat exchange is shown by a one-dot chain line 25. In the graph G2, for convenience, a value of the simulation result by natural heat exchange is shown at a position where the front face wind velocity is 0 (zero).

As shown in the graph G2, in a case where the front face wind velocity is 0 (zero), in all heat exchangers, the pressure loss is 0 (zero). In a range of the front face wind velocity to 1.5 (m/s), a result shows that the pressure loss of the heat exchanger for forced heat exchange is the greatest, and the pressure loss of the heat exchanger for natural heat exchange is the smallest. In a range of the front face wind velocity higher than 1.5 (m/s), a result shows that the pressure loss of the heat exchanger 1 according to the present embodiment is the greatest, and the heat exchange amount of the heat exchanger for natural heat exchange is the smallest. From the results, it has been confirmed that, in a case where the front face wind velocity is high, since the pressure loss is increased, and the heat exchange efficiency is also increased, the heat exchanger 1 according to the present embodiment can be used in the heat exchange by the first mode. In the heat exchanger 1 according to the present embodiment, although the disposition interval of the fins is greater than the fins of the heat exchanger for forced heat exchange, it is considered that the pressure loss greater than the fins of the heat exchanger for forced heat exchange is generated in the vicinity of 1.5 (m/s) since forming of turbulence with an increase in wind velocity is promoted by the undulating shape of the first fin portion. It has been confirmed that, in a case where the front face wind velocity is low, since the pressure loss is small like the heat exchanger for natural heat exchange, the heat exchanger 1 according to the present embodiment can be used in the heat exchange by the second mode. With this, it has been confirmed that the heat exchanger 1 according to the present embodiment can be used in both the first mode and the second mode.

(Switching Between First Mode and Second Mode)

In the present embodiment, the control unit 3 is configured to switch between the first mode and the second mode based on the temperature of the heat exchange target.

Specifically, the control unit 3 forces air to flow into the first flow path 11 with the fan 2 such that the temperature of the heat exchange target fluid flowing into the second flow path 12 acquired by the second temperature sensor 5 is equal to or lower than a predetermined temperature. In the present embodiment, the control unit 3 acquires a difference between the temperature of air flowing into the first flow path 11 acquired by the first temperature sensor 4 and the temperature of the heat exchange target fluid flowing into the second flow path 12 acquired by the second temperature sensor 5. The control unit 3 adjusts an inflow amount of air by the fan 2 based on the acquired temperature difference between air flowing into the first flow path 11 and the heat exchange target fluid flowing into the second flow path 12. That is, in a case where the temperature difference between air and the heat exchange target is small, the control unit 3 increases the inflow amount of air by the fan 2. In a case where the temperature difference between air and the heat exchange target is large, the control unit 3 decreases the inflow amount of air by the fan 2.

The control unit 3 stops the operation of the fan 2 in a case where the acquired temperature difference between air flowing into the first flow path 11 and the heat exchange target fluid flowing into the second flow path 12 is large, and the needed heat exchange amount is decreased. That is, the control unit 3 performs control for performing heat exchange in the second mode. In performing heat exchange in the second mode, the fan 2 is stopped. Accordingly, air passes through the gap of the fan 2 by natural convection, and flows into the first flow path 11 from the opening 11*a* on the Z2 direction side.

Figure 7:
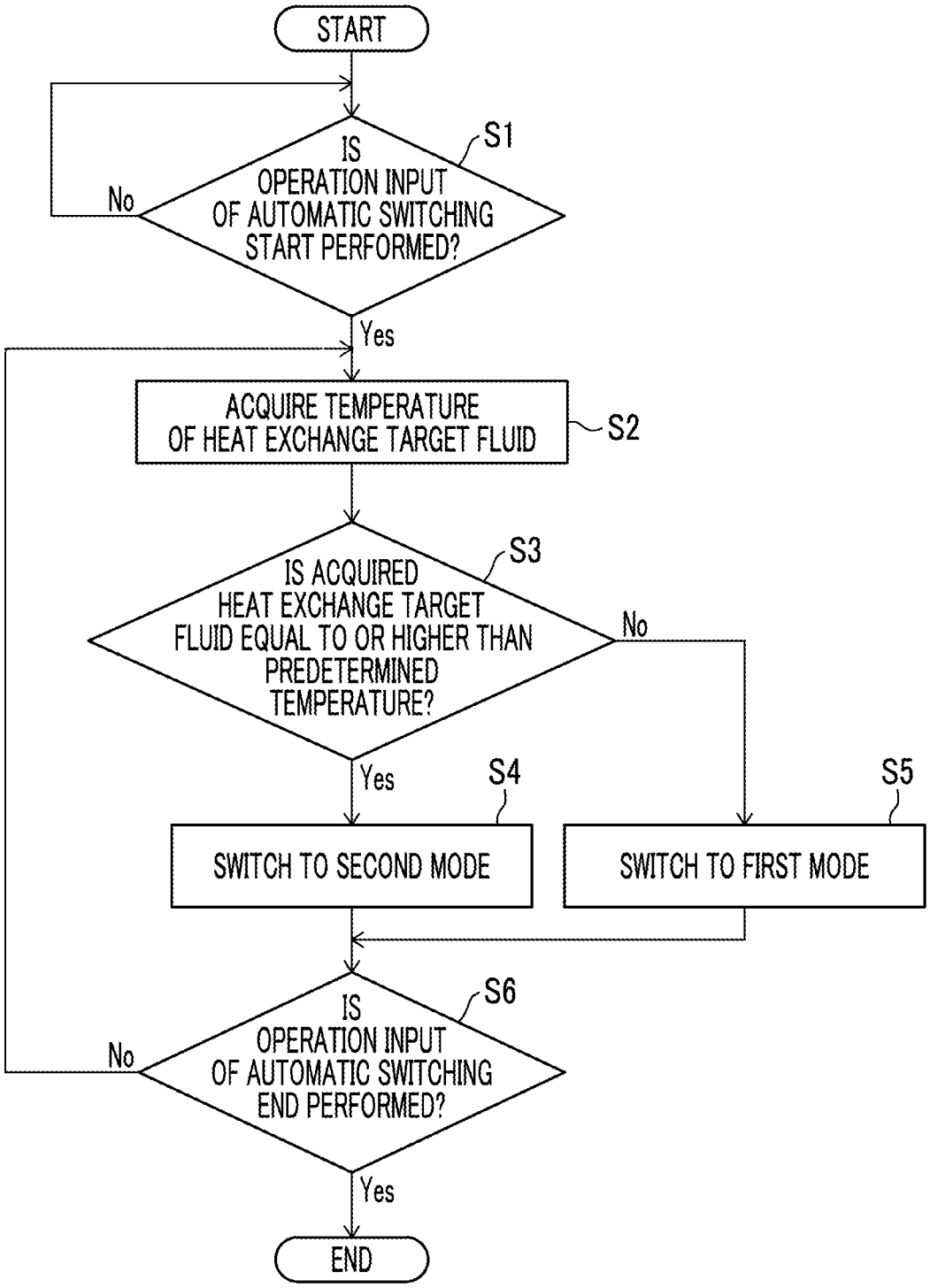
FIG. 7 is a flowchart illustrating processing in which the heat exchange system according to the first embodiment switches between a first mode and a second mode.

Next, processing in which the control unit 3 according to the present embodiment switches between the first mode and the second mode will be described with reference to FIG. 7.

In Step S1, the control unit 3 determines whether or not an operation input to start automatic switching between natural heat exchange and forced heat exchange is performed. In a case where the operation input to start automatic switching is performed, the process proceeds to Step S2. In a case where the operation input to start automatic switching is not performed, the processing of Step S1 is repeated.

In Step S2, the control unit 3 acquires the temperature of the heat exchange target fluid flowing into the second flow path 12. Specifically, the control unit 3 acquires the temperature of the heat exchange target fluid flowing into the second flow path 12 with the second temperature sensor 5 (see FIG. 1).

In Step S3, the control unit 3 determines whether or not the temperature of the heat exchange target fluid is equal to or higher than the predetermined temperature. In a case where the temperature of the heat exchange target fluid is equal to or higher than the predetermined temperature, the process proceeds to Step S4. In a case where the temperature of the heat exchange target fluid is lower than the predetermined temperature, the process proceeds to Step S5.

In Step S4, the control unit 3 performs switching to the second mode. Specifically, the control unit 3 performs switching to the second mode by stopping the fan 2. In a case where the fan 2 is stopped, the processing of Step S4 is omitted. That is, in a case where the operation is performed in the second mode, the processing of Step S4 is omitted.

In a case where the process proceeds from Step S3 to Step S5, in Step S5, the control unit 3 performs switching to the first mode. Specifically, the control unit 3 performs switching to the first mode by operating the fan 2. The control unit 3 may control the amount of air flowing into the first flow path 11 with the fan 2 based on the temperature of air acquired by the first temperature sensor 4. In a case where the fan 2 is being operated, the processing of Step S5 is omitted.

In Step S6, the control unit 3 determines whether or not an operation input to end automatic switching is performed. In a case where the operation input to end automatic switching is not performed, the process proceeds to Step S2. In a case where the operation input to end automatic switching is performed, the process ends.

Effects of First Embodiment

In the first embodiment, the following effects can be obtained.

In the first embodiment, as described above, the plurality of fin portions 13*a* are disposed in parallel at the predetermined intervals p1 in the width direction (Y direction) of the first flow path 11 through which air flows, and are formed to have the undulating shape from one end 11*b* toward the other end 11*c* of the first flow path 11 in the width direction of the first flow path 11, the first flow path 11 is configured to be used in both the first mode where heat exchange is performed by forcing air to flow in and the second mode where heat exchange is performed by natural convection. Thus, since the first flow path 11 is used in both the first mode and the second mode, it is possible to restrain the structure of the heat exchanger 1 from being complicated, compared to a configuration in which both flow paths of a flow path for a first mode and a flow path for a second mode are provided. Since the plurality of fin portions 13*a* have the undulating shape in the width direction (Y direction) of the first flow path 11, it is possible to promote heat transfer with turbulence of flown-in air, compared to a configuration in which the plurality of fin portions 13*a* do not have the undulating shape. It is also possible to increase a heat transfer area. As a result, it is possible to switch between performing heat exchange by natural convection and heat exchange by forcing air to flow in, and to restrain the structure of the heat exchanger 1 from being complicated.

Since the plurality of fin portions 13*a* are provided continuously from one end 11*b* to the other end 11*c* of the first flow path 11, and undulate periodically such that the other end of the first flow path 11 is visible as viewed from one end 11*b* of the first flow path 11, a through flow path is formed in the first flow path 11. Accordingly, it is possible to suppress an increase in pressure loss of air flowing in the first flow path 11, compared to a configuration in which a through flow path is not formed in the first flow path 11 with the plurality of fin portions 13*a*. As a result, even in a case where the plurality of fin portions 13*a* have the undulating shape, it is possible to secure heat exchange efficiency in the second mode where heat exchange is performed by natural convection.

The plurality of fin portions 13*a* undulate such that the undulating pattern having the same waveform is repeated at the fixed undulation width W in the width direction (Y direction) of the first flow path 11, and the undulation width W is at least a size less than a half of the interval p1 of the plurality of fin portions 13*a*. Thus, the plurality of fin portions 13*a* undulate such that the undulating pattern having the same waveform is repeated at the fixed undulation width W in the width direction (Y direction) of the first flow path 11. For this reason, it is possible to simplify the structure (shape) of the plurality of fin portions 13*a*, compared to a configuration in which the undulation width W and/or the undulating pattern of the plurality of fin portions 13*a* is different halfway. The undulation width W of the plurality of fin portions 13*a* is at least the size less than a half of the disposition interval p1 of the plurality of fin portions 13*a*. Thus, it is possible to make a configuration in which the other end 11*c* of the first flow path 11 is visible as viewed from one end 11*b* of the first flow path 11, and to secure heat exchange efficiency in the second mode. As a result, it is possible to achieve simplification of the structure (shape) of the plurality of fin portions 13*a* and securing of heat exchange efficiency in the second mode.

Since the interval p1 of the plurality of fin portions 13*a* is within a range of equal to or greater than 5 mm and equal to or less than 10 mm, it is possible to dispose the plurality of fin portions 13*a* at intervals suitable for the second mode where heat exchange is performed by natural convection. In a case where the disposition interval of the plurality of fin portions 13*a* is set within the range, while high performance is obtained in the second mode where heat exchange is performed by natural convection of air, the disposition interval is large for the first mode where heat exchange is performed by forcing air to flow in. That is, in a case where the plurality of fin portions 13*a* are disposed at the disposition interval within the range of equal to or greater than 5 mm and equal to or less than 10 mm, heat exchange performance by the first mode is degraded. Accordingly, as shown in the above-described example, it has been confirmed that the plurality of fin portions 13*a* have the undulating shape, whereby it is possible to secure high performance even in heat exchange by the first mode even in a case where the plurality of fin portions 13*a* are disposed at the disposition interval within the range of equal to or greater than 5 mm and equal to or less than 10 mm.

The plurality of fin portions 13*a* are disposed at the equal intervals over the whole width in the width direction (Y direction) of the first flow path 11. Thus, it is possible to perform heat exchange by the first mode and heat exchange by the second mode using the whole first flow path 11, unlike a configuration in which a part where heat exchange is performed by the first mode and a part where heat exchange is performed by the second mode are formed by changing the interval p1 of the plurality of fin portions 13*a* halfway of the first flow path 11. As a result, it is possible to suppress degradation of heat exchange efficiency of each heat exchange mode.

Since the control unit 3 is configured to switch between the first mode and the second mode based on the temperature of the heat exchange target, the first mode and the second mode are switched based on the temperature of the heat exchange target. Accordingly, it is possible to suppress an increase in power consumption, for example, compared to a configuration in which heat exchange is constantly performed by the first mode. It is also possible to efficiently perform the heat exchange of the heat exchange target, for example, compared to a configuration in which heat exchange is constantly performed by the second heat exchange mode. As a result, it is possible to efficiently perform the heat exchange of the heat exchange target while suppressing an increase in power consumption.

The heat exchange target includes the heat exchange target fluid, and the heat exchanger 1 further includes the second flow path 12 through which the heat exchange target fluid flows in a state of being in contact with the separate plate 10 on which the plurality of fin portions 13*a* are provided. Thus, it is possible to easily bring the separate plate 10 on which the plurality of fin portions 13*a* are provided, and the heat exchange target fluid into contact with each other by making the heat exchange target fluid flow into the second flow path 12, and to easily perform the heat exchange of the heat exchange target fluid.

In a fin structure of the heat exchanger 1, the plurality of fin portions 13*a* are disposed in parallel at the predetermined intervals p1 in the width direction (Y direction) of the first flow path 11 through which air flows, and are formed to have the undulating shape from one end 11*b* toward the other end 11*c* of the first flow path 11 in the width direction of the first flow path 11, and in performing the heat exchange of the heat exchange target, the first flow path 11 is configured to be used in both forced heat exchange where the heat exchange of the heat exchange target is performed by forcing air to flow into the first flow path 11 and natural heat exchange where the heat exchange of the heat exchange target is performed by natural convection. Thus, it is possible to provide the fin structure of the heat exchanger 1 capable of switching between performing heat exchange by natural convection and heat exchange by forcing air to flow in, and restraining the structure of the heat exchanger 1 from being complicated, like the above-described heat exchange system 100. In the fin structure of the heat exchanger 1, the plurality of fin portions 13*a* are disposed at the equal intervals over the whole width in the width direction (Y direction) of the first flow path 11. Thus, it is possible to perform heat exchange by the first mode and heat exchange by the second mode using the whole first flow path 11, unlike a configuration in which a part where heat exchange is performed by the first mode and a part where heat exchange is performed by the second mode are formed by changing the disposition interval p1 of the plurality of fin portions 13*a* halfway of the first flow path 11. As a result, it is possible to suppress degradation of heat exchange efficiency of each heat exchange mode.

In the fin structure of the heat exchanger 1, since the plurality of fin portions 13*a* are provided continuously from one end 11*b* to the other end 11*c* of the first flow path 11, and undulate periodically such that the other end of the first flow path 11 is visible as viewed from one end 11*b* of the first flow path 11, a through flow path is formed in the first flow path 11. Accordingly, it is possible to suppress an increase in pressure loss of air flowing in the first flow path 11, compared to a configuration in which a through flow path is not formed in the first flow path 11 with the plurality of fin portions 13*a*. As a result, even in a case where the plurality of fin portions 13*a* have the undulating shape, it is possible to secure heat exchange efficiency in the second mode where heat exchange is performed by natural convection.

Second Embodiment

Next, an angle range of a maximum inclination angle θ (see FIG. 8) of a connecting portion 11*h* (see FIG. 8) of each of a plurality of fin portions 131 (see FIG. 8) of a first corrugated fin 130 (see FIG. 8) according to a second embodiment will be described with reference to FIGS. 8 to 11. The same configurations as in the above-described first embodiment are represented by the same reference signs, and detailed description thereof will not be repeated.

Figure 8:
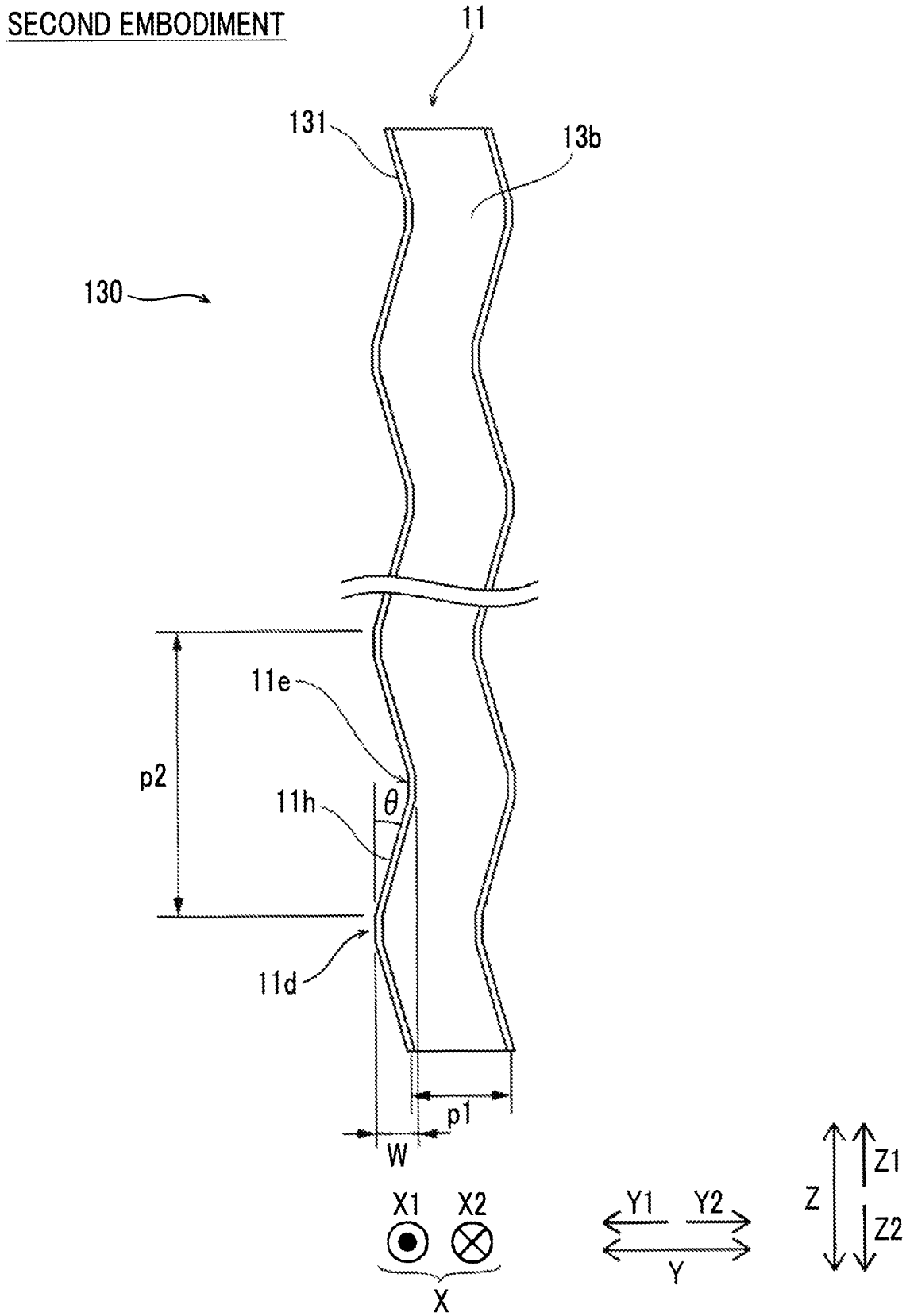
FIG. 8 is a schematic view illustrating a maximum inclination angle of a connecting portion according to a second embodiment.

The plurality of fin portions 131 according to the second embodiment have the same configuration as the plurality of fin portions 13*a* according to the above-described first embodiment, except for a case where the maximum inclination angle θ is different. As shown in FIG. 8, the plurality of fin portions 131 undulate such that an undulating pattern having the same waveform is repeated at a fixed undulation width W in the width direction (Y direction) of the first flow path 11. The undulating pattern includes a crest portion 11*d* that protrudes to one side (Y1 direction side) in the width direction of the first flow path 11, a trough portion 11*e* that protrudes to the other side (Y2 direction side), and a connecting portion 11*h* that connects the crest portion 11*d* and the trough portion 11*e*. In the present embodiment, the maximum inclination angle θ of the connecting portion 11*h* with respect to a direction (Z direction) from one end 11*b* side toward the other end 11*c* side of the first flow path 11 falls within an angle range of equal to or greater than 10 degrees and equal to or less than 30 degrees. An example shown in FIG. 8 is a case where the maximum inclination angle θ is 20 degrees.

In the example shown in FIG. 8, although each of the crest portion 11*d* and the trough portion 11*e* has a shape extending along a direction (Z direction) in which the first flow path 11 extends, the crest portion 11*d* and the trough portion 11*e* may not extend along the direction (Z direction) in which the first flow path 11 extends. That is, the connecting portions 11*h* may be continuously connected to form an undulating pattern. In this case, out of contacts between the connecting portions 11*h*, a contact that protrudes to one side (Y1 direction side) may be referred to as a crest portion, and a contact that protrudes to the other side (Y2 direction side) may be referred to as a trough portion.

A period p2 of undulation is determined by the disposition interval p1 of the fin portions 131 and the maximum inclination angle θ of the connecting portion 11*h*. In the second embodiment, the heat exchanger 1 is used in both the first mode and the second mode. Accordingly, the period p2 of undulation is set to a range based on a range of the disposition interval p1 of the fin portions 131, a range of the maximum inclination angle θ of the connecting portion 11*h*, and a heat discharge amount capable of using both the first mode and the second mode. Specifically, a lower limit value of the period p2 of undulation is 0.5 times of the disposition interval p1 of the fin portions 131. An upper limit value of the period p2 of undulation is a value in a case where the first flow path 11 is configured such that the other end 11*c* of the first flow path 11 is visible as viewed from one end 11*b* of the first flow path 11 in a case where the disposition interval p1 of the fin portions 131 is set to a range of equal to or greater than 5 mm and equal to or less than 10 mm, and the maximum inclination angle θ of the connecting portion 11*h* is set to be equal to or greater than 10 degrees and equal to or less than 30 degrees.

Figure 9:
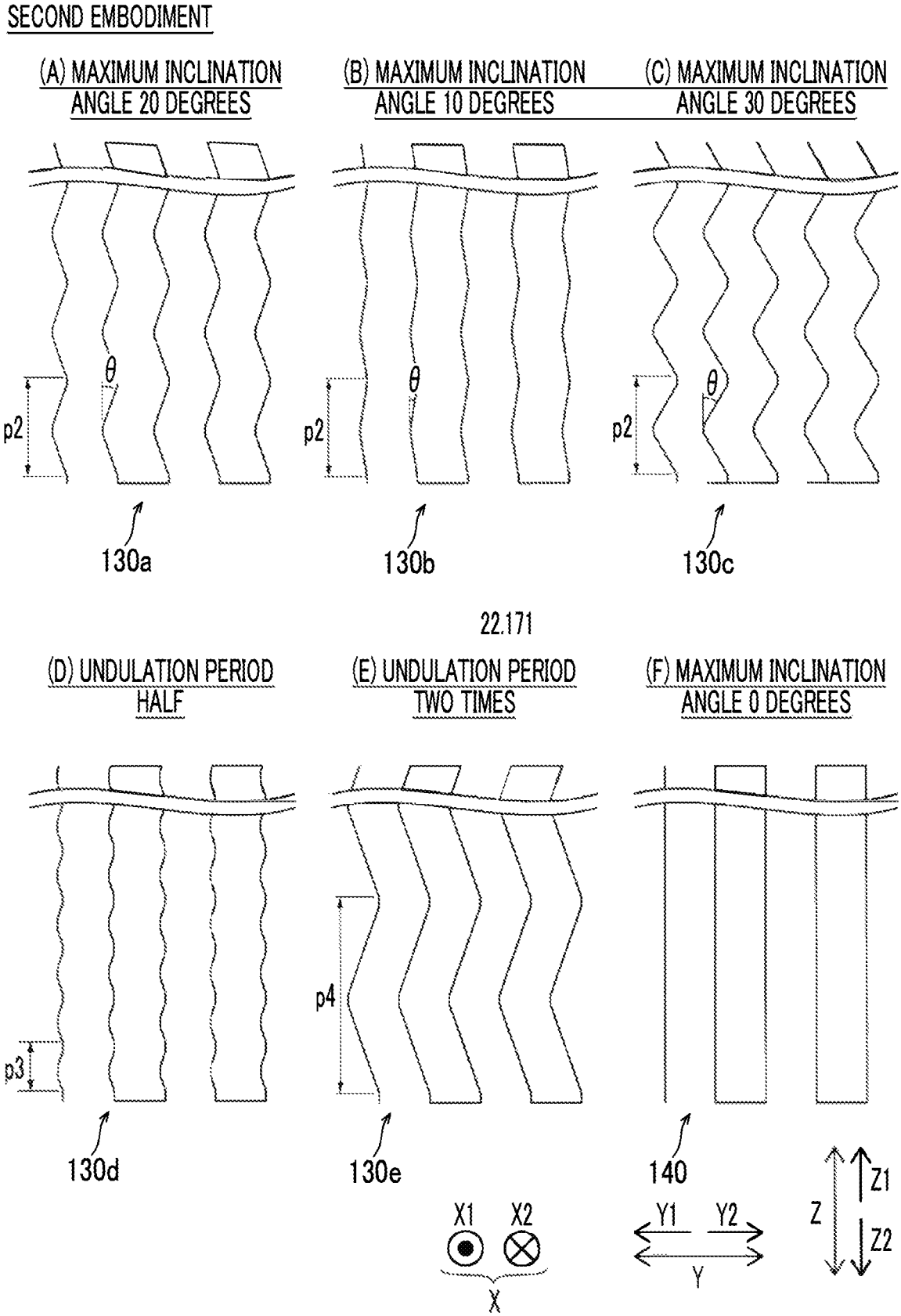
FIG. 9 is a schematic view (A) to a schematic view (F) illustrating a heat exchanger used in a simulation according to the second embodiment and a heat exchanger of a comparative example.

Next, simulation results of a heat exchange amount and a pressure loss in a case where the maximum inclination angle θ of the connecting portion 11*h* and the period p2 of undulation are changed will be described with reference to FIGS. 9 to 11. Simulation results described below are results using a first corrugated fin 130 in which the maximum inclination angle θ of the connecting portion 11*h* in the heat exchanger 1 is set to 20 degrees, 10 degrees, and 30 degrees, the first corrugated fin 130 in which the maximum inclination angle θ of the connecting portion 11*h* is 20 degrees, and a period p3 of undulation is a half of the period p2 of undulation, and a first corrugated fin 130 in which a period p4 of undulation is two times of the period p2 of undulation, as shown in FIG. 9. The simulation results described below also include a result using a first corrugated fin 140 in which the maximum inclination angle θ of the connecting portion 11*h* is 0 degrees (a so-called plain fin), as a comparative example. As shown in FIG. 9(F), the first corrugated fin 140 according to the comparative example has a shape with no undulation in a fin portion.

As shown in FIG. 9(A), in a first corrugated fin 130*a*, connecting portion 11*h* is disposed such that the maximum inclination angle θ of the connecting portion 11*h* is 20 degrees. As shown in FIG. 9(B), in a first corrugated fin 130*b*, the connecting portion 11*h* is disposed such that the maximum inclination angle θ of the connecting portion 11*h* is 10 degrees. As shown in FIG. 9(C), in a first corrugated fin 130*c*, the connecting portion 11*h* is disposed such that the maximum inclination angle θ of the connecting portion 11*h* is 30 degrees. As shown in FIGS. 9(A) to 9(C), the period of undulation of the first corrugated fin 130*a* to the first corrugated fin 130*c* is the period p2.

As shown in FIG. 9(D), a first corrugated fin 130*d* is configured such that the maximum inclination angle θ of the connecting portion 11*h* is 20 degrees, and the period p4 of undulation is a half of the period p2 of undulation. As shown in FIG. 9(E), a first corrugated fin 130*e* is configured such that the maximum inclination angle θ of the connecting portion 11*h* is 20 degrees, and the period p4 of undulation is two times of the period p2 of undulation.

(Simulation Result of Heat Exchange Amount to Maximum Inclination Angle of Connecting Portion and Period of Undulation)

Figure 10:
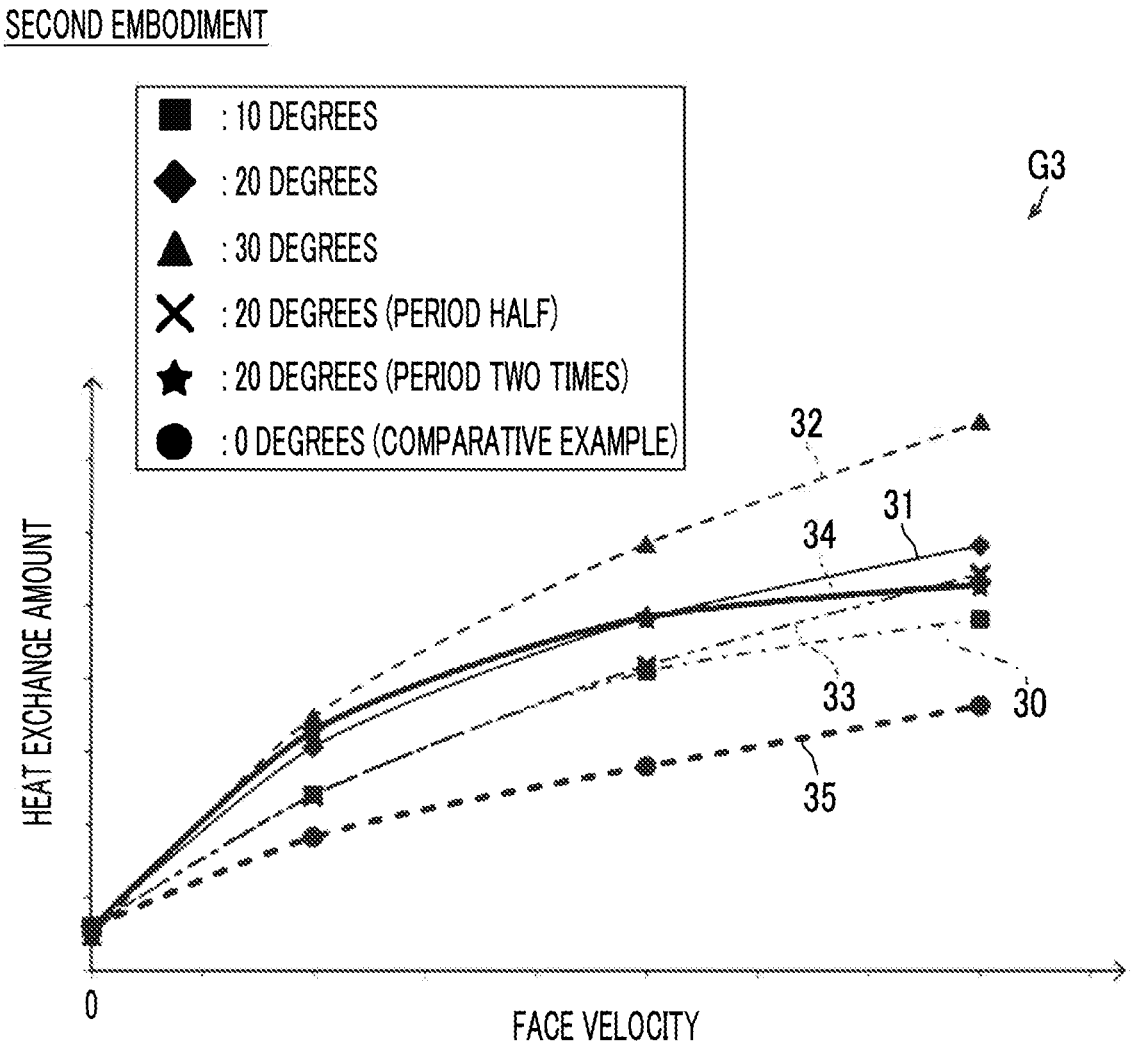
FIG. 10 is a simulation result showing change in heat exchange amount in changing a front face wind velocity in the heat exchanger according to the second embodiment in which an angle of a connecting portion of a first flow path and a period are made different.

A graph G3 shown in FIG. 10 takes a heat exchange amount as the vertical axis and takes a front face wind velocity as the horizontal axis. In the graph G3, a simulation result in a case where the maximum inclination angle θ of the connecting portion 11*h* is 10 degrees is shown by a one-dot chain line 30. In the graph G3, a simulation result in a case where the maximum inclination angle θ of the connecting portion 11*h* is 20 degrees is shown by a solid line 31. In the graph G3, a simulation result in a case where the maximum inclination angle θ of the connecting portion 11*h* is 30 degrees is shown by a broken line 32. In the graph G3, a simulation result in a case where the maximum inclination angle θ of the connecting portion 11*h* is 20 degrees, and the period p3 of undulation is a half of the period p2 of undulation is shown by a two-dot chain line 33. In the graph G3, a simulation result in a case where the maximum inclination angle θ of the connecting portion 11*h* is 20 degrees, and the period p4 of undulation is two times of the period p2 of undulation is shown by a bold line 34. In the graph G3, a simulation result according to the comparative example is shown by a bold dotted line 35. In the graph G3, a case where the front face wind velocity is 0 (zero) means heat exchange by the second mode. In the graph G3, a case where the front face wind velocity is equal to or higher than 0 (zero) means heat exchange by the first mode.

As shown in the graph G3, in a case of the second mode, all simulation results in a case where the maximum inclination angle θ of the connecting portion 11*h* is 10 degrees, 20 degrees, and 30 degrees show the substantially same heat exchange amount as the simulation result according to the comparative example.

As shown in the graph G3, in a case of heat exchange by the first mode, the simulation result in a case where the maximum inclination angle θ of the connecting portion 11*h* is 10 degrees shows that the heat exchange amount is increased with respect to the simulation result according to the comparative example. Specifically, in the first mode, the simulation result in a case where the maximum inclination angle θ of the connecting portion 11*h* is 10 degrees shows that the heat exchange amount is about 1.4 times on average with respect to the simulation result according to the comparative example.

As shown in the graph G3, the simulation result in a case where the maximum inclination angle θ of the connecting portion 11*h* is 20 degrees shows that, in a case of the first mode, the heat exchange amount is about 1.7 times on average with respect to the simulation result according to the comparative example.

As shown in the graph G3, the simulation result in a case where the maximum inclination angle θ of the connecting portion 11*h* is 30 degrees shows that, in a case of the first mode, the heat exchange amount is about 2.0 times on average with respect to the simulation result according to the comparative example.

As shown in the graph G3, in a case of the first mode, it has been confirmed that, as the maximum inclination angle θ of the connecting portion 11*h* is increased, the heat exchange amount is increased.

As shown in the graph G3, in a case of the second mode, both the simulation result in a case where the maximum inclination angle θ of the connecting portion 11*h* is 20 degrees, and the period p3 of undulation is a half of the period p2 of undulation and the simulation result in a case where the maximum inclination angle θ of the connecting portion 11*h* is 20 degrees, and the period p3 of undulation is a half of the period p2 of undulation show the substantially same heat exchange amount as the simulation result according to the comparative example.

As shown in the graph G3, in a case of the first mode, the simulation result in a case where the period p3 of undulation is a half of the period p2 of undulation show that the heat exchange amount is increased with respect to the simulation result according to the comparative example. Specifically, the simulation result in a case where the period p3 of undulation is a half of the period p2 of undulation shows that, in a case of the first mode, the heat exchange amount is about 1.4 times on average compared to the simulation result according to the comparative example.

As shown in the graph G3, in a case of the first mode, the simulation result in a case where the period p4 of undulation is two times of the period p2 of undulation shows that the heat exchange amount is increased compared to the simulation result according to the comparative example. Specifically, the simulation result in a case where the period p4 of undulation is two times of the period p2 of undulation shows that, in a case of the first mode, the heat exchange amount is about 1.7 times on average compared to the simulation result according to the comparative example.

As shown in the graph G3, in comparing the simulation result of the period p4 of undulation with the simulation result of the period p3 of undulation, in regard to the heat exchange amount in a case of the first mode, the simulation result of the period p4 of undulation shows the heat exchange amount equal to or greater than the simulation result of the period p3 of undulation.

With the above, it has been confirmed that, in a case where the maximum inclination angle θ of the connecting portion 11*h* is equal to or greater than 10 degrees and equal to or less than 30 degrees, the heat exchange amount is large compared to the comparative example. It has been confirmed that, in a range of the maximum inclination angle θ of the connecting portion 11*h* of 10 degrees to 30 degrees, as the angle is increased, the heat exchange amount is increased. It has been confirmed that an influence of the period p2 of undulation on the heat exchange amount is less than an influence of the maximum inclination angle θ of the connecting portion 11*h* on the heat exchange amount.

(Simulation Result of Pressure Loss to Maximum Inclination Angle of Connecting Portion and Period of Undulation)

Figure 11:
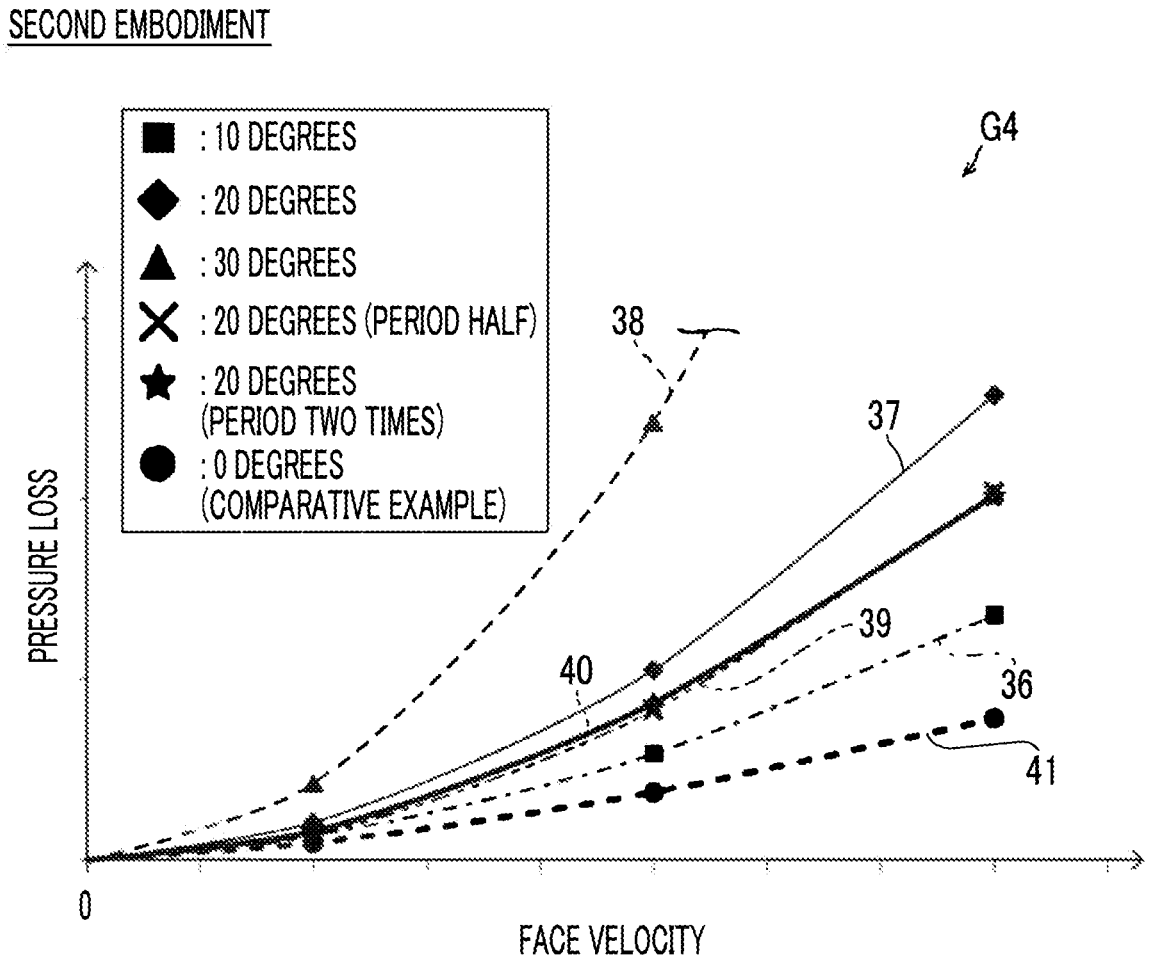
FIG. 11 is a simulation result showing change in pressure loss in changing the front face wind velocity in the heat exchanger according to the second embodiment in which the angle of the connecting portion of the first flow path and the period are made different.

A graph G4 shown in FIG. 11 takes a pressure loss as the vertical axis and takes a front face wind velocity as the horizontal axis. In the graph G4, a simulation result in a case where the maximum inclination angle θ of the connecting portion 11*h* is 10 degrees is shown by a one-dot chain line 36. In the graph G4, a simulation result in a case where the maximum inclination angle θ of the connecting portion 11*h* is 20 degrees is shown by a solid line 37. In the graph G4, a simulation result in a case where the maximum inclination angle θ of the connecting portion 11*h* is 30 degrees is shown by a broken line 38. In the graph G4, a simulation result in a case where the maximum inclination angle θ of the connecting portion 11*h* is 20 degrees, and the period p3 of undulation is a half of the period p2 of undulation is shown by a two-dot chain line 39. In the graph G4, a simulation result in a case where the maximum inclination angle θ of the connecting portion 11*h* is 20 degrees, and the period p4 of undulation is two times of the period p2 of undulation is shown by a bold line 40. In the graph G4, a simulation result according to the comparative example is shown by a bold dotted line 41. In the graph G4, a case where the front face wind velocity is 0 (zero) means heat exchange by the second mode. In the graph G4, a case where the front face wind velocity is equal to or higher than 0 (zero) means heat exchange by the first mode.

As shown in the graph G4, in a case of the second mode, all simulation results in a case where the maximum inclination angle θ of the connecting portion 11*h* is 10 degrees, 20 degrees, and 30 degrees show the substantially same pressure loss as the simulation result according to the comparative example.

As shown in the graph G4, in a case of the first mode, the simulation result in a case where the maximum inclination angle θ of the connecting portion 11*h* is 10 degrees shows the pressure loss is increased compared to the simulation result according to the comparative example. Specifically, the simulation result in a case where the maximum inclination angle θ of the connecting portion 11*h* is 10 degrees shows that, in a case of the first mode, the pressure loss is about 1.6 times on average with respect to the simulation result according to the comparative example.

As shown in the graph G4, the simulation result in a case where the maximum inclination angle θ of the connecting portion 11*h* is 20 degrees shows that, in a case of the first mode, the pressure loss is about 2.8 times on average with respect to the simulation result according to the comparative example.

As shown in the graph G4, the simulation result in a case where the maximum inclination angle θ of the connecting portion 11*h* is 30 degrees shows that, in a case of the first mode, the pressure loss is about 6.3 times on average with respect to the simulation result according to the comparative example.

As shown in the graph G4, in a case of the first mode, it has been confirmed that, as the maximum inclination angle θ of the connecting portion 11*h* is increased, the pressure loss is increased.

As shown in the graph G4, in a case of the first mode, the simulation result in a case where the period p3 of undulation is a half of the period p2 of undulation shows that the pressure loss is increased compared to the simulation result according to the comparative example. Specifically, the simulation result in a case where the period p3 of undulation is a half of the period p2 of undulation shows that, in a case of the first mode, the pressure loss is about 2.2 times compared to the simulation result according to the comparative example.

As shown in the graph G4, in a case of the first mode, the simulation result in a case where the period p4 of undulation is two times of the period p2 of undulation shows that the pressure loss is increased compared to the simulation result according to the comparative example. Specifically, the simulation result in a case where the period p4 of undulation is two times of the period p2 of undulation shows that, in a case of the first mode, the pressure loss is about 2.2 times on average compared to the simulation result according to the comparative example.

As shown in the graph G4, in comparing the simulation result of the period p4 of undulation with the simulation result of the period p3 of undulation, the pressure loss in a case of the first mode is the substantially same in the simulation result of the period p4 of undulation and the simulation result of the period p3 of undulation.

With the above, it has been confirmed that, in a case where the maximum inclination angle θ of the connecting portion 11*h* is equal to or greater than 10 degrees and equal to or less than 30 degrees, the pressure loss is large compared to the comparative example. In a range of the maximum inclination angle θ of the connecting portion 11*h* of 10 degrees to 30 degrees, it has been confirmed that, as the angle is increased, the pressure loss is increased. It has been confirmed that an influence of the period p2 of undulation on the pressure loss is less than an influence of the maximum inclination angle θ of the connecting portion 11*h* on the pressure loss.

From the graphs G3 and G4, it has been confirmed that, in a case where the maximum inclination angle θ of the connecting portion 11*h* is 10 degrees, while an increasing rate of the heat exchange amount is not large, the efficiency of heat exchange is high, compared to a case where the maximum inclination angle θ of the connecting portion 11*h* is 20 degrees and 30 degrees. In a case where the maximum inclination angle θ of the connecting portion 11*h* is 30 degrees, it has been confirmed that, while the efficiency of heat exchange is not high, the increasing rate of the heat exchange amount is large, compared to a case where the maximum inclination angle θ of the connecting portion 11*h* is 10 degrees and 20 degrees. That is, it has been confirmed that, preferably, the maximum inclination angle θ of the connecting portion 11*h* falls within a range of equal to or greater than 10 degrees and equal to or less than 30 degrees. In a case where the maximum inclination angle θ of the connecting portion 11*h* is 20 degrees, it has been confirmed that the angle can achieve both a heat discharge amount and heat exchange efficiency. Evaluation of the increasing rate of the heat exchange amount and evaluation of the efficiency of heat exchange are performed based on an amount of change in heat exchange amount and an amount of change in pressure loss with respect to a plane fin in a case where the maximum inclination angle θ of the connecting portion 11*h* is changed. The efficiency of heat exchange is a value that is calculated by dividing the heat exchange amount by the pressure loss.

Effects of Second Embodiment

In the second embodiment, the following effects can be obtained.

In the second embodiment, as described above, the plurality of fin portions 131 undulate such that the undulating pattern having the same waveform is repeated at the fixed undulation width W in the width direction (Y direction) of the first flow path 11. The undulating pattern includes the crest portion 11*d* that protrudes to one side (Y1 direction side) in the width direction of the first flow path 11, the trough portion 11*e* that protrudes to the other side (Y2 direction side), and the connecting portion 11*h* that connects the crest portion 11*d* and the trough portion 11*e*. The maximum inclination angle θ of the connecting portion 11*h* with respect to the direction (Z direction) from one end 11*b* side toward the other end 11*c* side of the first flow path 11 falls within the angle range of equal to or greater than 10 degrees and equal to or less than 30 degrees.

Here, in a case where the period p2 of undulation of the first flow path 11 is fixed, as the maximum inclination angle θ of the connecting portion 11*h* is greater, an effect of turbulence in the first flow path 11 is increased, and a heat transfer area can be increased. In a case where the heat transfer area of the first flow path 11 is increased, as shown in FIG. 10, it is possible to improve heat exchange performance by the first mode where air is forced to flow in. Note that, in a case where the maximum inclination angle θ of the connecting portion 11*h* is large, as shown in FIG. 11, the pressure loss in the first flow path 11 increases. As shown in FIG. 10, in a case where the period p2 of undulation of the first flow path 11 is fixed, as the maximum inclination angle θ of the connecting portion 11*h* is smaller, the effect of turbulence of the first flow path 11 is decreased, and the heat transfer area is decreased. Thus, heat exchange performance by the first mode is degraded. Note that, in a case where the maximum inclination angle θ of the connecting portion 11*h* is small, as shown in FIG. 11, the pressure loss of the first flow path 11 decreases. Accordingly, the present inventors have conducted studies by a simulation and have confirmed that, in a case where the maximum inclination angle θ of the connecting portion 11*h* falls within the angle range of equal to or greater than 10 degrees and equal to or less than 30 degrees, it is possible to secure high performance in both heat exchange in the first mode and heat exchange in the second mode. In a case where the maximum inclination angle θ of the connecting portion 11*h* is 20 degrees, it has been confirmed that the angle can achieve both a heat discharge amount and heat exchange efficiency.

Other effects of the second embodiment are the same effects as the effects of the above-described first embodiment.

Modification Examples

The embodiment disclosed herein is to be considered merely illustrative and not restrictive in all respects. The scope of the invention is defined not by the description of the above-described embodiments, but by the claims, and is intended to include all changes (modification examples) within the meaning and range equivalent to the claims.

For example, in the above-described first and second embodiments, although an example of a configuration in which the first flow path 11 is formed to extend in the up-down direction (Z direction) has been shown, the invention is not limited thereto. For example, the first flow path 11 may be formed to extend in an oblique direction.

Figure 12:
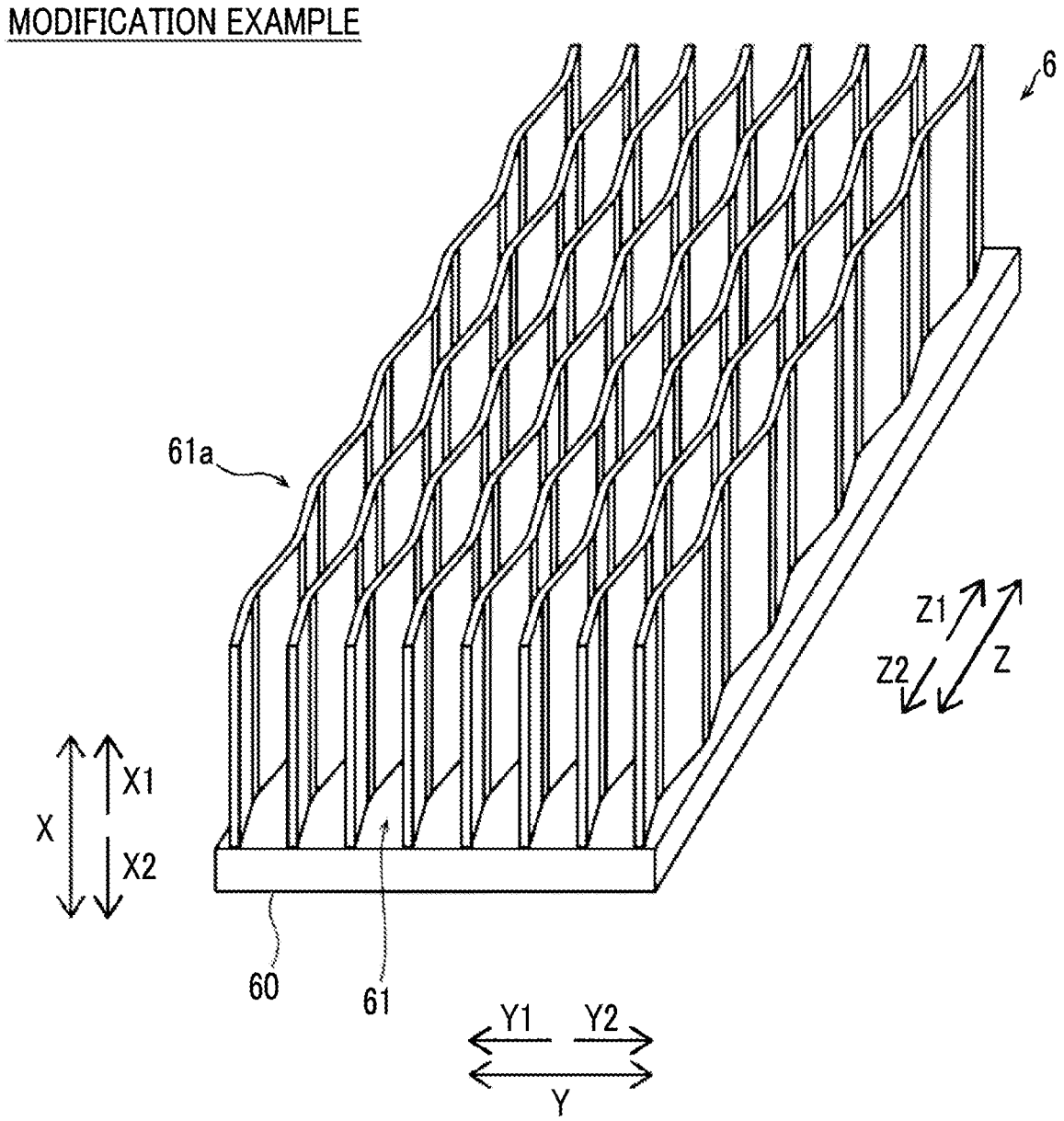
FIG. 12 is a perspective view showing a base portion and a plurality of fin portions of a heat exchanger according to a modification example.

In the above-described first and second embodiments, although an example of a configuration in which the heat exchanger 1 is a plate fin type heat exchanger has been shown, the invention is not limited thereto. For example, the heat exchanger 1 may be a fin and tube type heat exchanger other than a plate fin. Like a heat sink 6 according to a modification example shown in FIG. 12, the invention may be applied to a heat sink. In the heat sink 6 shown in FIG. 12, a plurality of fin portions 61*a* are provided to extend upward from a base portion 60. The base portion 60 is, for example, a metal member having a plate shape. In the heat sink 6, a space between a plurality of fin portions 61*a* forms a first flow path 61. In the heat sink 6, for example, a semiconductor element or the like is a heat exchange target, and the heat exchange of the semiconductor element or the like is performed by bringing the semiconductor element or the like into contact with the base portion 60. Even in the heat sink 6 according to the modification example, the plurality of fin portions 61*a* are formed to have an undulating shape from one end 11*b* toward the other end 11*c* of the first flow path 11 in the width direction (Y direction) of the first flow path 11 of the plurality of fin portions 61*a*. That is, the first flow path 11 may be divided by a plurality of fins in which an individual first fin portion is provided individually, not by a corrugated fin. In an example shown in FIG. 12, although the first flow path 11 is formed to extend in the up-down direction (Z direction), the first flow path 11 may be formed to extend in an oblique direction.

In the above-described first and second embodiments, although an example of a configuration in which the first flow path 11 and the second flow path 12 are perpendicular to each other has been shown, the invention is not limited thereto. For example, the first flow path 11 and the second flow path 12 may be configured to face each other or the first flow path 11 and the second flow path 12 may be configured to be in parallel with each other.

In the above-described first and second embodiments, although an example of a configuration in which the first flow path 11 and the second flow path 12 are alternately laminated in the X direction has been shown, the invention is not limited thereto. The first flow path 11 and the second flow path 12 may not be alternately laminated. For example, the first flow path 11, the first flow path 11, the second flow path 12, the first flow path 11, the first flow path 11, the second flow path 12, and the like may be laminated in this order.

In the above-described first and second embodiments, although an example of a configuration in which the plurality of fin portions 13*a* (a plurality of fin portions 131) are disposed at the equal intervals over the whole width in the width direction (Y direction) of the first flow path 11 has been shown, the invention is not limited thereto. For example, the plurality of fin portions 13*a* (the plurality of fin portions 131) may not be disposed at equal intervals over the whole width in the Y direction. Note that, in a case where the plurality of fin portions 13*a* (the plurality of fin portions 131) are not disposed at equal intervals over the whole width in the Y direction, since the structure of the heat exchanger 1 is complicated, it is preferable that the plurality of fin portions 13*a* (the plurality of fin portions 131) are disposed at equal intervals over the whole width in the Y direction.

In the above-described first and second embodiments, although an example of a configuration in which the plurality of fin portions 13*a* (the plurality of fin portions 131) undulate at the fixed undulation width W in the width direction (Y direction) of the first flow path 11 has been shown, the invention is not limited thereto. For example, the undulation width W the plurality of fin portions 13*a* (the plurality of fin portions 131) may not be fixed. Note that, in a case where the undulation width W of the plurality of fin portions 13*a* (the plurality of fin portions 131) is not fixed, since the structure of the heat exchanger 1 is complicated, it is preferable that the undulation width W of the plurality of fin portions 13*a* (the plurality of fin portions 131) is fixed.

In the above-described first and second embodiments, although an example of a configuration in which the plurality of fin portions 13*a* (the plurality of fin portions 131) undulated such that the undulating pattern having the same waveform is repeated has been shown, the invention is not limited thereto. For example, the plurality of fin portions 13*a* (the plurality of fin portions 131) may have an undulating shape in which undulating patterns having different waveforms are combined. Note that, in a case where the plurality of fin portions 13*a* (the plurality of fin portions 131) have an undulating shape in which undulating patterns having different waveforms are combined, since the structure of the heat exchanger 1 is complicated, it is preferable that the plurality of fin portions 13*a* (the plurality of fin portions 131) undulate such that the pattern having the same waveform is repeated.

In the above-described first and second embodiments, although an example of a configuration in which the interval p1 of the plurality of fin portions 13*a* (the plurality of fin portions 131) is about 8 mm has been shown, the invention is not limited thereto. The interval p1 of the plurality of fin portions 13*a* (the plurality of fin portions 131) may be, for example, about 6 mm or may be about 9 mm. As long as the interval p1 of the plurality of fin portions 13*a* is within a range of equal to or greater than 5 mm and equal to or less than 10 mm, the interval p1 of the plurality of fin portions 13*a* (the plurality of fin portions 131) may have any value.

In the above-described second embodiment, although an example of a configuration in which the fin portion 13*a* is configured such that the crest portion 11*d* and the trough portion 11*e* are connected by the connecting portion 11*h* inclined at a fixed angle has been shown, the invention is not limited thereto. For example, the crest portion 11*d* and the trough portion 11*e* may be connected by a connecting portion in which the angle changes continuously. As an example, the first flow path 11 may be a so-called sine curve shape in top view. In a case where the first flow path 11 has a sine curve shape, a maximum angle of the connecting portion in which the angle continuously changes may fall within an angle range of equal to or greater than 10 degrees and equal to or less than 30 degrees.

In the above-described first and second embodiments, although an example of a configuration in which the control unit 3 switches between the first mode and the second mode based on the temperature difference between air and the heat exchange target has been shown, the invention is not limited thereto. For example, an input reception unit that receives an input of a user may be provided, and the control unit 3 may be configured to switch between the first mode and the second mode based on an input signal of the user.

In the above-described first and second embodiments, although an example of a configuration in which the fan 2 is provided in the opening 11*a* on the Z2 direction side has been shown, the invention is not limited thereto. For example, the fan 2 may be provided in the opening 11*a* on the Z1 direction side. That is, in the first mode, heat exchange may be performed by forcing air to flow in from the Z1 direction side with the fan 2, and in the second mode, heat exchange may be performed by making air flow in from the Z2 direction side by natural convection. The position where the fan 2 is provided may be any of the opening 11*a* on the Z1 direction side and the opening 11*a* on the Z2 direction side.

In the above-described first and second embodiments, although an example of a configuration in which the fan 2 sends air to the first flow path 11 has been shown, the invention is not limited thereto. For example, the fan 2 may be configured to make air flow into the first flow path 11 by sucking air.

In the above-described first and second embodiments, although an example of a configuration in which the fan 2 is provided in a state of being in contact with the surface 1*a* on the Z2 direction side to cover the opening 11*a* on the Z2 direction side has been shown, the invention is not limited thereto. For example, the fan 2 may not be configured to cover the opening 11*a*. In a case where the fan 2 is not configured to cover the opening 11*a*, the fan 2 may be connected by a duct, a casing, or the like and may be provided at a remote position.

In the above-described first and second embodiments, although an example of a configuration in which cooling of the heat exchange target is performed has been shown, the present application is not limited thereto. For example, the heat exchanger 1 may b configured to perform heating of the heat exchange target.

REFERENCE SIGNS LIST

1, 6: heat exchanger
2: fan
3: control unit
10: separate plate (base portion)
11, 41: first flow path
11*d*: crest portion
11*e*: trough portion
11*h*: connecting portion
12: second flow path
13*a*, 61*a*, 131: a plurality of fin portions
60: base portion
100: heat exchange system
p1: disposition interval (disposition interval of a plurality of fin portions)
W: undulation width
θ: maximum inclination angle

The invention claimed is:

1. A heat exchange system comprising:

a heat exchanger comprising a base portion that is contactable with a heat exchange target, and a plurality of fin portions provided to extend upward from the base portion;

wherein the plurality of fin portions form a first flow path through which air flows;

wherein the plurality of fin portions are disposed at a fixed interval over a whole width in a width direction of the first flow path;

wherein the plurality of fin portions are provided continuously from a first end to a second end of the first flow path;

wherein the plurality of fin portions undulate periodically with a fixed width in the width direction of the first flow path;

wherein the fixed width is a size less than a half of the fixed interval; and wherein the first flow path is configured to be used in both a first mode where heat exchange of the heat exchange target is performed by forcing air to flow into the first flow path and a second mode where the heat exchange of the heat exchange target is performed by natural convection.

2. The heat exchange system according to claim 1, wherein a waveform of undulating of the first flow path includes a crest portion that protrudes to a first side, a trough portion that protrudes to a second side, and a connecting portion that connects the crest portion and the trough portion, in the width direction of the first flow path, and a maximum inclination angle of the connecting portion with respect to a direction from the first side to the second side of the first flow path is within an angle range of equal to or greater than 10 degrees and equal to or less than 30 degrees.

3. The heat exchange system according to claim 1, wherein a disposition interval of the plurality of fin portions is within a range of equal to or greater than 5 mm and equal to or less than 10 mm.

4. The heat exchange system according to claim 1, further comprising a fan that makes air flow into the first flow path; and a controller that performs control for switching between the first mode and the second mode, wherein the controller is configured to switch between the first mode and the second mode based on a temperature of the heat exchange target.

5. The heat exchange system according to claim 1, wherein the heat exchange target includes a heat exchange target fluid, and the heat exchanger further includes a second flow path through which the heat exchange target fluid flows in a state of being in contact with the base portion.

* * * * *